US012173607B2

(12) United States Patent
Sekiyama et al.

(10) Patent No.: US 12,173,607 B2
(45) Date of Patent: Dec. 24, 2024

(54) TUNNEL EXCAVATION DEVICE

(71) Applicant: KOMATSU LTD., Tokyo (JP)

(72) Inventors: Naoki Sekiyama, Tokyo (JP); Masahiro Suwano, Tokyo (JP); Hiroshi Asano, Tokyo (JP); Taku Arakawa, Tokyo (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 17/909,830

(22) PCT Filed: Feb. 26, 2021

(86) PCT No.: PCT/JP2021/007242
§ 371 (c)(1),
(2) Date: Sep. 7, 2022

(87) PCT Pub. No.: WO2021/192808
PCT Pub. Date: Sep. 30, 2021

(65) Prior Publication Data

US 2024/0200449 A1 Jun. 20, 2024

(30) Foreign Application Priority Data

Mar. 27, 2020 (JP) ..... 2020-058001

(51) Int. Cl.
*E21D 9/10* (2006.01)
*E21D 9/11* (2006.01)

(52) U.S. Cl.
CPC ..... *E21D 9/1093* (2013.01); *E21D 9/11* (2013.01)

(58) Field of Classification Search
CPC ..... E21D 9/06; E21D 9/1093; E21D 9/11
See application file for complete search history.

(56) References Cited

U.S. PATENT DOCUMENTS 3,598,445 A 8/1971 Winberg
3,859,810 A 1/1975 Winberg et al.
3,861,748 A 1/1975 Cass
(Continued)

FOREIGN PATENT DOCUMENTS

CN 1140790 A 1/1997
CN 104395555 A 3/2015
(Continued)

OTHER PUBLICATIONS

The International Search Report for the corresponding international application No. PCT/JP2021/007242, issued on May 18, 2021.
(Continued)

*Primary Examiner* — Carib A Oquendo
(74) *Attorney, Agent, or Firm* — Global IP Counselors, LLP

(57) ABSTRACT

The tunnel excavation device includes a front body section and a rear body section. The front body section includes a cutter head, a cutter head support, and a vertical shoe. The rear body section is disposed to a rear of the front body section and includes a gripper section for obtaining a reaction force when excavating. The cutter head includes a plurality of roller cutters. The cutter head support supports the cutter head. The vertical shoe is disposed below the cutter head support and is provided in a turnable manner to the cutter head support.

7 Claims, 20 Drawing Sheets

(56) References Cited

U.S. PATENT DOCUMENTS

| | | | | | |
|---|---|---|---|---|---|
| 3,957,310 | A | | 5/1976 | Winberg et al. | |
| 4,494,799 | A | | 1/1985 | Snyder | |
| 4,778,220 | A | * | 10/1988 | Linde | E21D 9/1093 299/33 |
| 5,005,911 | A | | 4/1991 | Fikse | |
| 5,931,601 | A | * | 8/1999 | Terada | E21B 7/28 405/138 |
| 2015/0078831 | A1 | | 3/2015 | Kawai et al. | |
| 2019/0112924 | A1 | * | 4/2019 | Kawai | E21D 9/003 |

FOREIGN PATENT DOCUMENTS

| | | | | |
|---|---|---|---|---|
| CN | 204532358 | U | | 8/2015 |
| JP | 6-117183 | A | | 4/1994 |
| JP | 6-43097 | U | | 6/1994 |
| JP | 10-220181 | A | | 8/1998 |
| JP | 10-331590 | A | | 12/1998 |
| JP | 11-22375 | A | | 1/1999 |
| JP | 11-311091 | A | | 11/1999 |
| JP | 2005120652 | | * | 1/2005 |
| JP | 2005-120651 | A | | 5/2005 |
| JP | 2005-120652 | A | | 5/2005 |
| JP | 2005-188210 | A | | 7/2005 |
| JP | 2005188210 | | * | 7/2005 |

OTHER PUBLICATIONS

The Examination report No. 1 for the corresponding Australian application No. 2021243549, dated Sep. 8, 2023.
The Office Action for the corresponding Chinese application No. 202180012621.X issued on Jun. 27, 2024.

* cited by examiner

TUNNEL EXCAVATION DEVICE

CROSS-REFERENCE TO RELATED APPLICATIONS

This application is a U.S. National stage application of International Application No. PCT/JP2021/007242, filed on Feb. 26, 2021. This U.S. National stage application claims priority under 35 U.S.C. § 119(a) to Japanese Patent Application No. 2020-058001, filed in Japan on Mar. 27, 2020, the entire contents of which are hereby incorporated herein by reference.

TECHNICAL FIELD

The present disclosure relates to a tunnel excavation device used when excavating a tunnel.

BACKGROUND INFORMATION

Conventionally, a tunnel excavation device is used for excavating rock in civil engineering work. The tunnel excavation device comprises a cutter head that includes cutters on the machine front surface, and gripper devices provided on the left and right side surfaces of a machine rear section (for example, see Japanese Laid-open Patent H10-220181).

In such a tunnel excavation device, the tunnel is excavated by extending a thrust cylinder while rotating the cutter head and pressing the cutter head against the rock while the left and right gripper devices are pressed against the tunnel left and right side walls.

SUMMARY

However, since civil engineering work generally involves digging in a straight line, a conventional tunnel excavation device cannot be used in a pit mine which requires sharp curve construction.

An object of the present disclosure is to provide a tunnel excavation device capable of sharp curve construction.

Means for Resolving the Problem

A tunnel excavation device according to the present disclosure includes a front body section and a rear body section. The front body section includes a cutter head, a cutter head support section, and a lower shoe. The rear body section is disposed rear of the front body portion and includes a gripper section for obtaining a reaction force when excavating. The cutter head includes a plurality of cutters. The cutter head support section supports the cutter head. The lower shoe is disposed below the cutter head support section and is provided in a turnable manner to the cutter head support section.

Effects of the Invention

According to the present disclosure, it is possible to provide a tunnel excavation device capable of sharp curve construction.

DESCRIPTION OF EMBODIMENTS

A tunnel excavation device of an embodiment according to the present disclosure will be explained with reference to the drawings.

The tunnel excavation device of the present embodiment is a so-called gripper tunnel boring machine (TBM) type or a hard rock TBM type of TBM (Tunnel Boring Machine). The tunnel excavation device of the present embodiment can be used in pit mining for mines and not only for construction work.

(Overall Configuration of Tunnel Excavation Device)

Figure 1A:
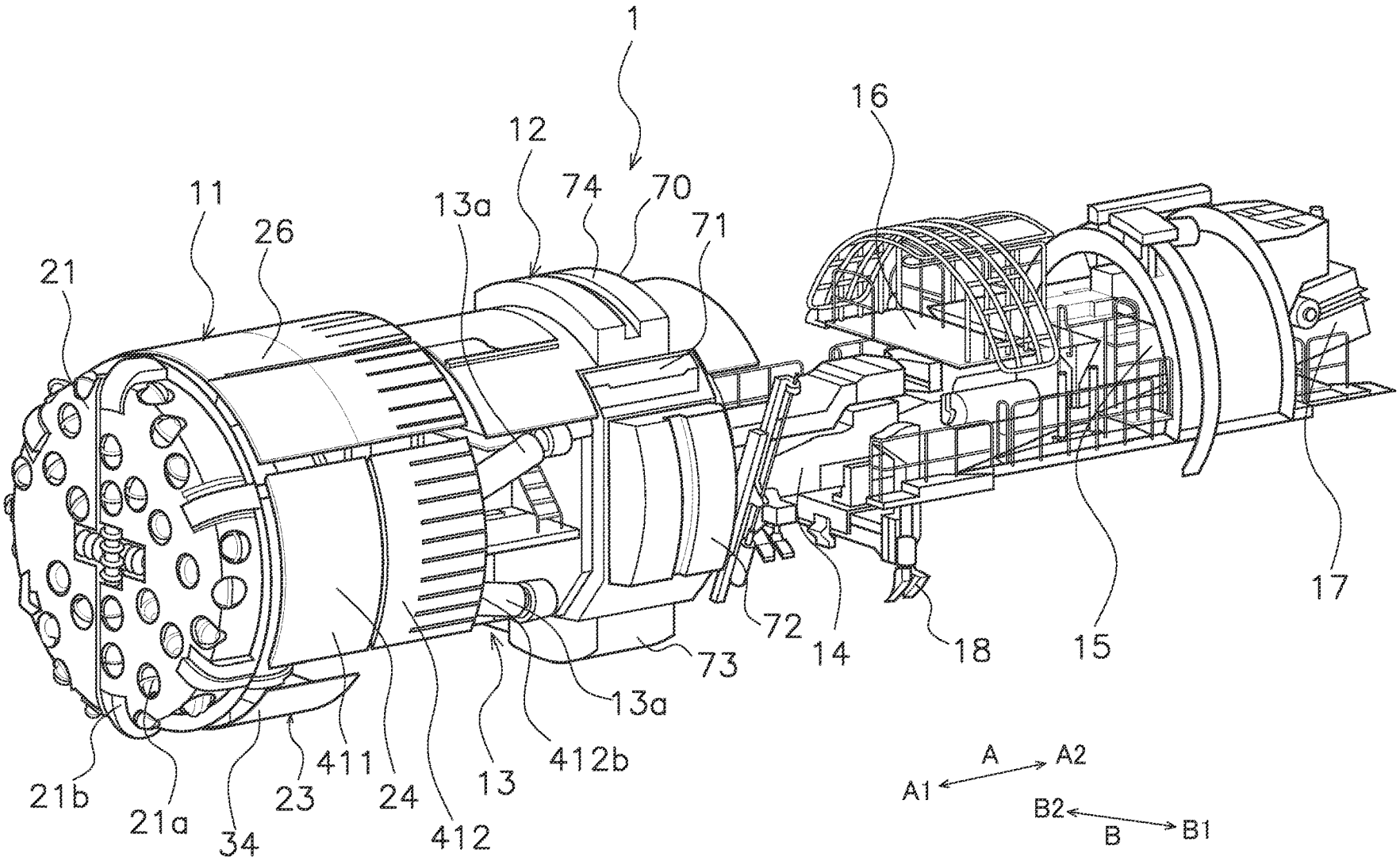
FIG. 1A is a perspective view illustrating a tunnel excavation device according to an embodiment of the present disclosure.
Figure 1B:
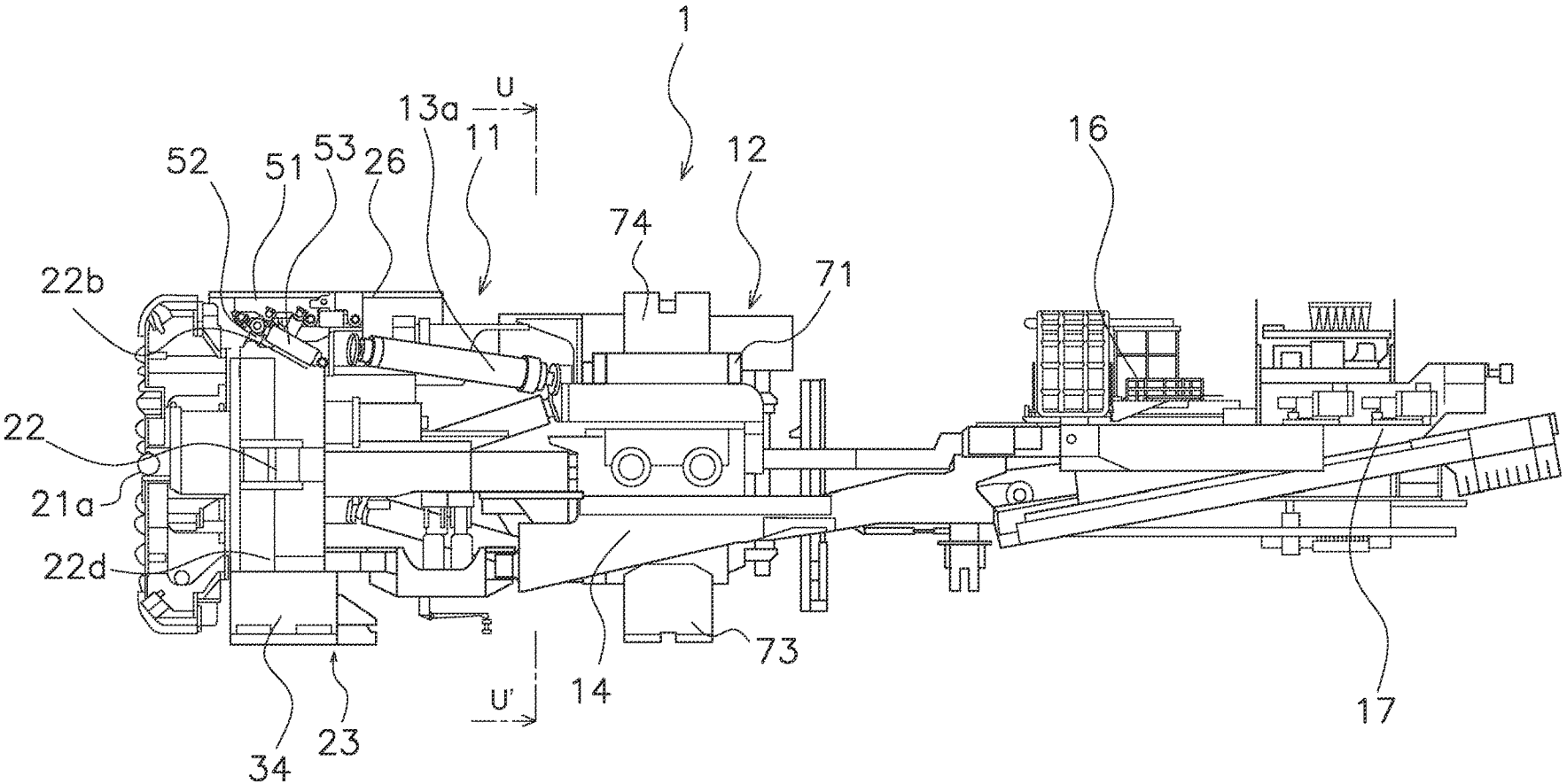
FIG. 1B is a side cross-sectional view illustrating an internal configuration of the tunnel excavation device in FIG. 1A.

FIG. 1A is a perspective view illustrating a tunnel excavation device 1 of the present embodiment. FIG. 1B is a side cross-sectional view of FIG. 1A.

The tunnel excavation device 1 of the present embodiment causes a cutter head 21 to rotate to perform excavating while being supported on the inner walls of the tunnel with a gripper section 70.

The tunnel excavation device 1 of the present embodiment has a front body section 11, a rear body section 12, a connecting section 13, a main beam 14, a frame 15, a work platform 16, a belt conveyor 17, and a rear support 18.

The front body section 11 has the cutter head 21 at the front end, as illustrated in FIG. 1A, and excavates rock. The rear body section 12 is disposed on the rear side of the front body section 11 and can be supported on the tunnel inner walls with the gripper section 70.

The connecting section 13 connects the front body section 11 and the rear body section 12 in a bendable manner. The connecting section 13 has a plurality of thrust cylinders 13*a*, and one end of each thrust cylinder 13*a* is turnably connected to the front body section 11 and the other end of each thrust cylinder 13*a* is turnably connected to the rear body section 12.

Figure 1C:
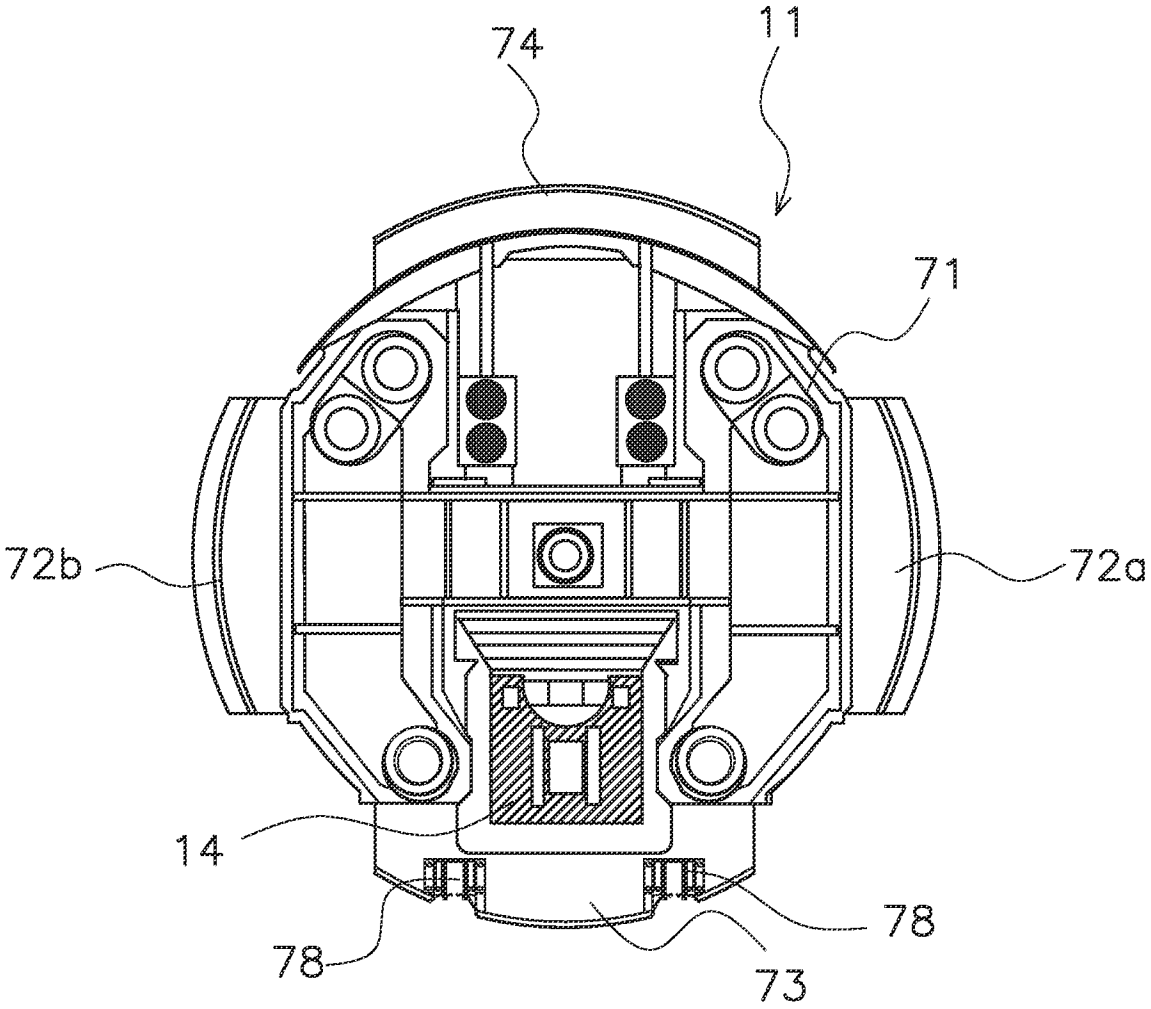
FIG. 1C is a diagram that illustrates a main beam and the rear body section along arrows U and U' in FIG. 1B.

FIG. 1C is a diagram illustrating the main beam 14 and the rear body section 12 along arrows U and U' in FIG. 1B. As illustrated in FIGS. 1B and 1C, the main beam 14 is connected to the front body section 11 by a turnable coupling member and supports the rear body section 12 in a manner that allows sliding forward and backward in the A direction. The main beam 14 extends from the rear body section 12 toward the rear. The frame 15 is turnably attached to the rear end of the main beam 14. The work platform 16 is provided for performing work for spreading netting onto the tunnel inner walls after the excavation, and is disposed above the frame 15.

The belt conveyor 17 is provided from the front body section 11 through the rear body section 12 to the lower side of the frame 15 and conveys rock and sand excavated by the cutter head 21 to the rear.

The rear support 18 is provided to the main beam 14 and supports the main beam 14 when the rear body section 12 is traveling forward.

Although not indicated in the drawings, a vehicle provided with a control device, a power supply device, and a hydraulic system and the like for driving the cutter head 21, the belt conveyor 17, the plurality of thrust cylinders 13*a*, and the gripper section 70 and the like is joined to the rear of the frame 15.

(Front Body Section 11)

The front body section 11 has the cutter head 21, a cutter head support 22 (see FIG. 2), a vertical support 23, side supports 24 and 25, and a roof support 26.

The cutter head 21 is provided to the front end of the front body section 11 and is provided so as to be able to rotate with respect to the cutter head support 22. As illustrated in FIG. 1A, the cutter head 21 has a plurality of roller cutters 21*a* provided to the excavation-side surface and scrapers 21*b* for taking in the excavated rock the inside of the cutter head 21.

Figure 2:
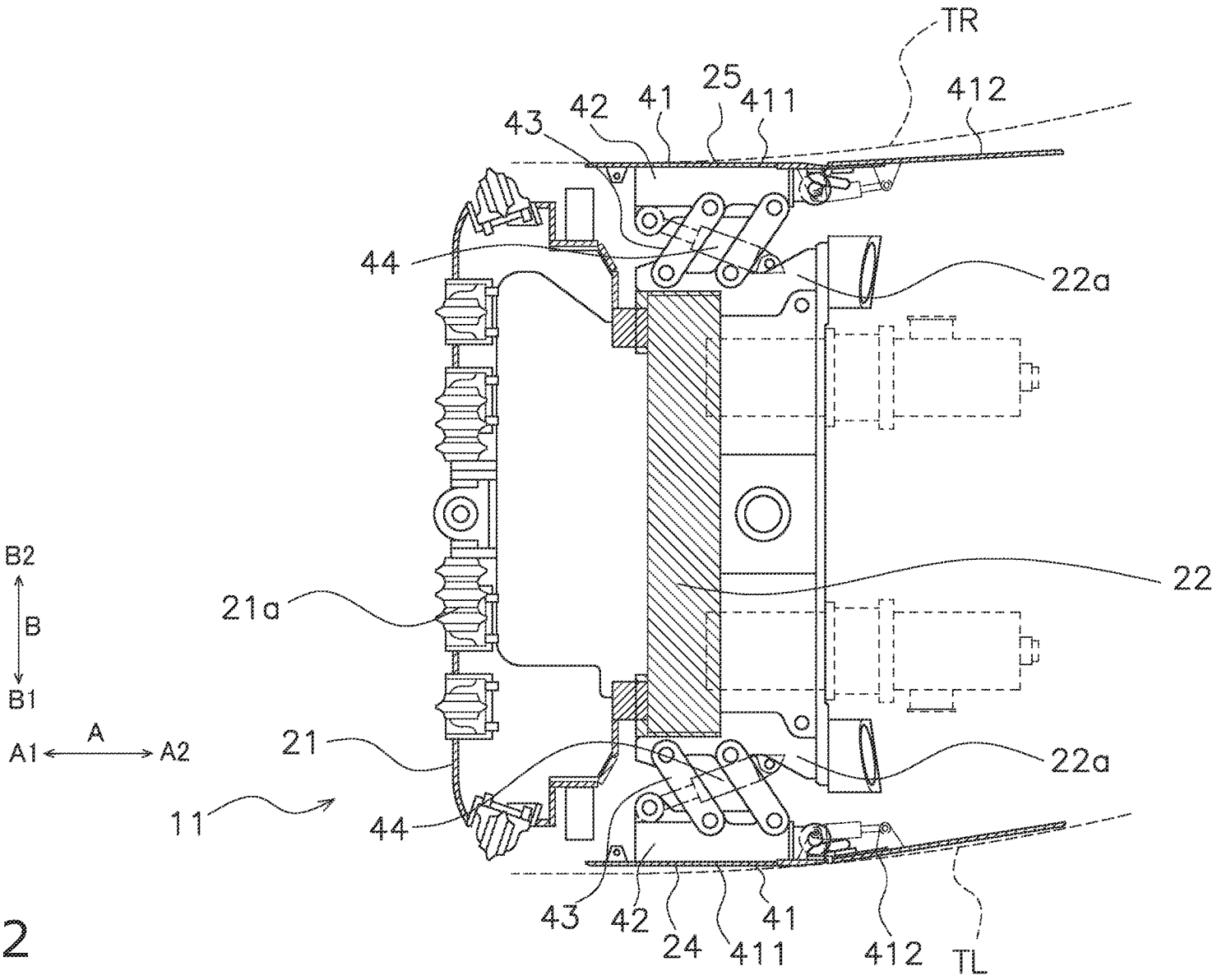
FIG. 2 is a plan cross-sectional view illustrating the front body section of the tunnel excavation device in FIG. 1A.

FIG. 2 is a schematic view of a plan cross-section illustrating a configuration of the front body section 11.

The cutter head support 22 is disposed to the rear of the cutter head 21. The cutter head support 22 rotatably supports the cutter head 21.

The vertical support 23, the pair of side supports 24 and 25, and the roof support 26 are attached to the cutter head support 22 and are disposed so as to encircle the circumference of the cutter head support 22. The vertical support 23, the pair of side supports 24 and 25, and the roof support 26 are provided for supporting the cutter head support 22 against the tunnel side wall for stabilization during excavation and for protecting the cutter head support 22 from rock slides from the side wall.

The vertical support 23 is disposed below the cutter head support 22. The pair of side supports 24 and 25 are disposed on either side in the width direction of the cutter head support 22. The roof support 26 is disposed above the cutter head support 22.

(Vertical Support 23)

Figure 3:
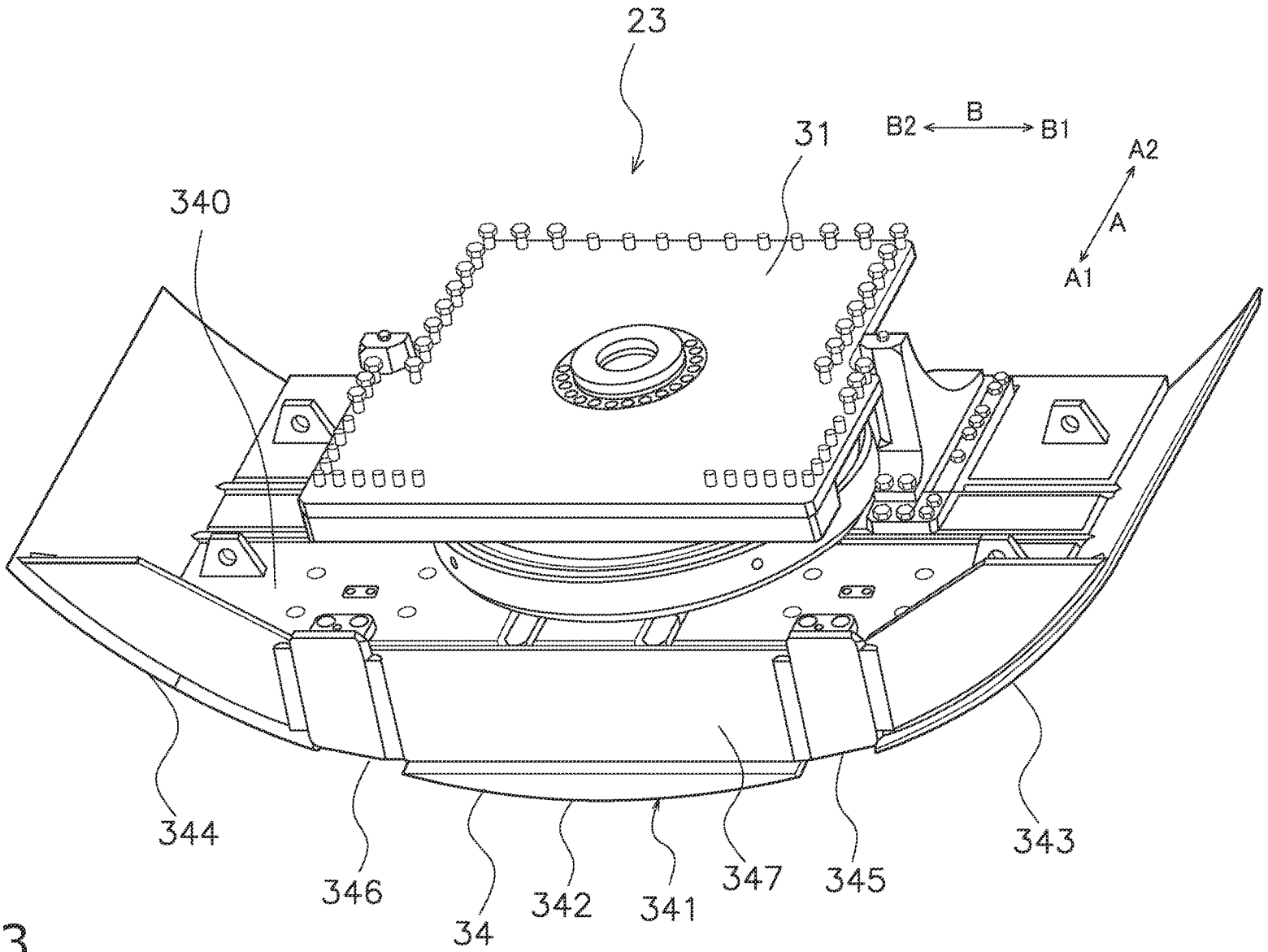
FIG. 3 is a perspective view illustrating a vertical support of the tunnel excavation device in FIG. 1A.

FIG. 3 is a perspective view illustrating the vertical support 23. In the drawings, the front-back direction is indicated by A, the forward direction is indicated by arrow A1 and the rearward direction is indicated by arrow A2. The arrow A indicates the front-back direction while the front body section 11 is not bent with respect to the rear body section 12 and is disposed in a straight line. The arrow B in the drawings indicates the width direction and is a direction perpendicular to the front-back direction A and horizontal. Within the width direction B, the leftward direction when facing in the forward direction A1 is indicated by B1 and the rightward direction when facing in the forward direction A1 is indicated by B2.

Figure 4:
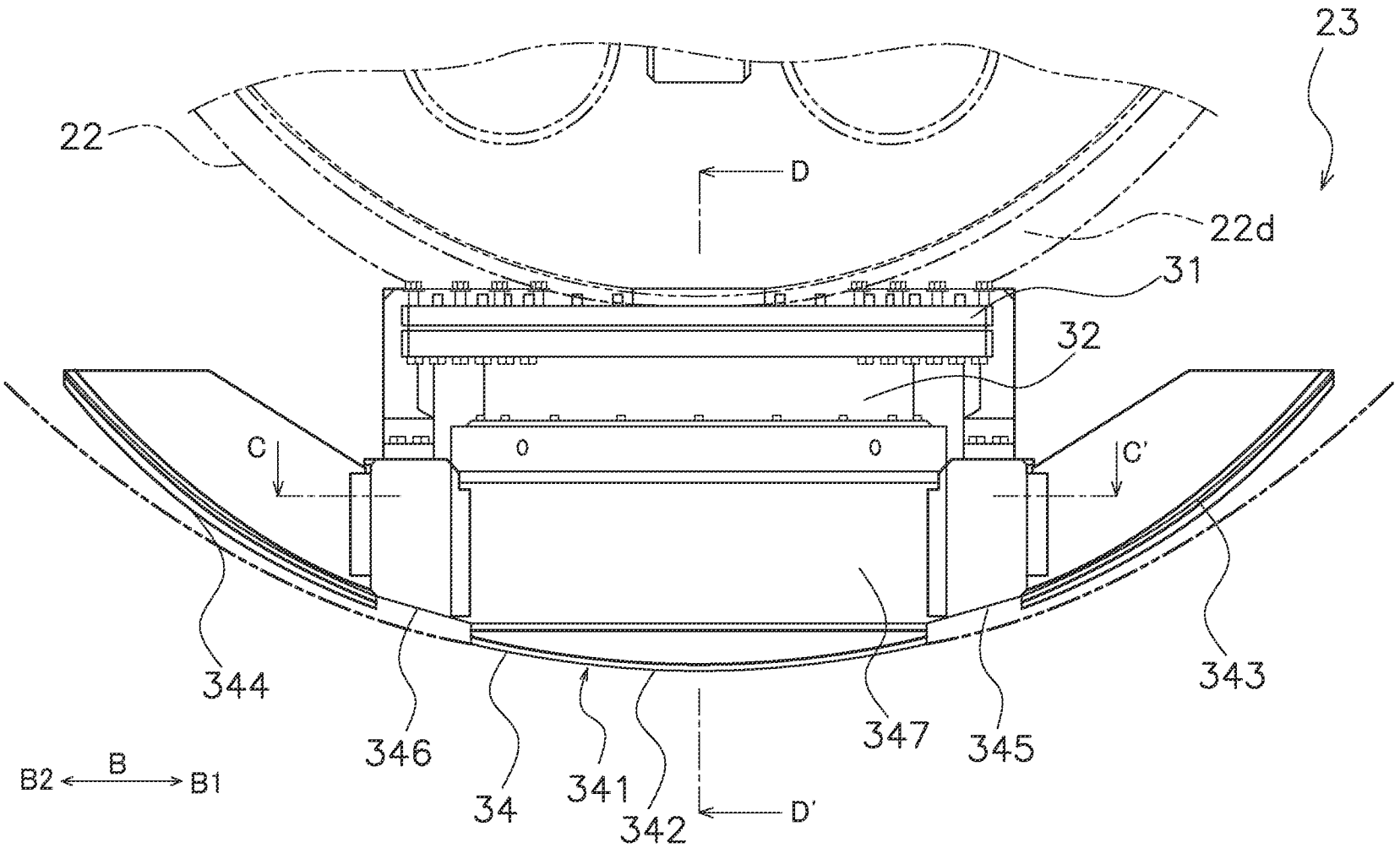
FIG. 4 is a front view of the vertical support in FIG. 3.
Figure 5:
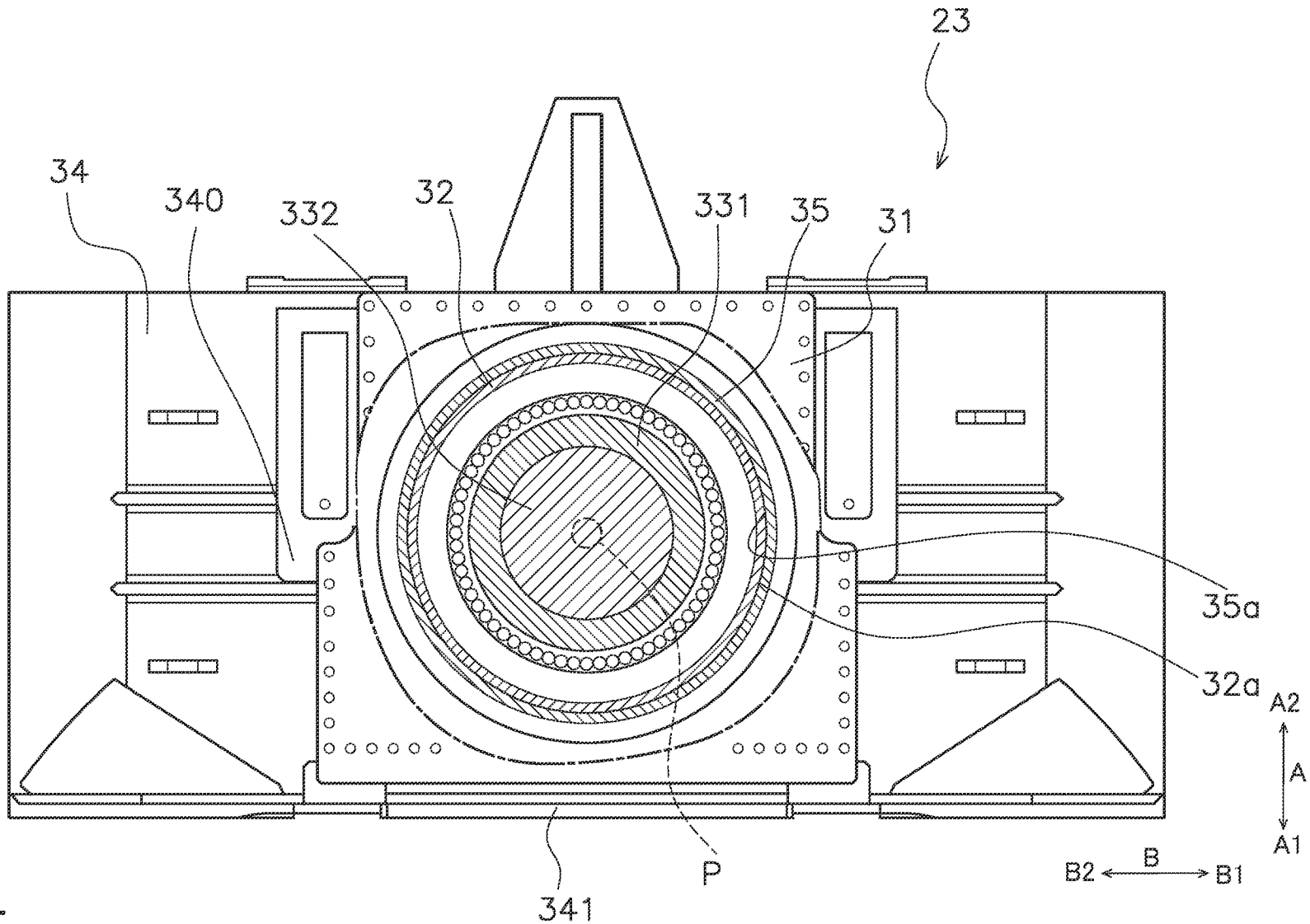
FIG. 5 is a partial cross-sectional plan view of the vertical support in FIG. 3.
Figure 6:
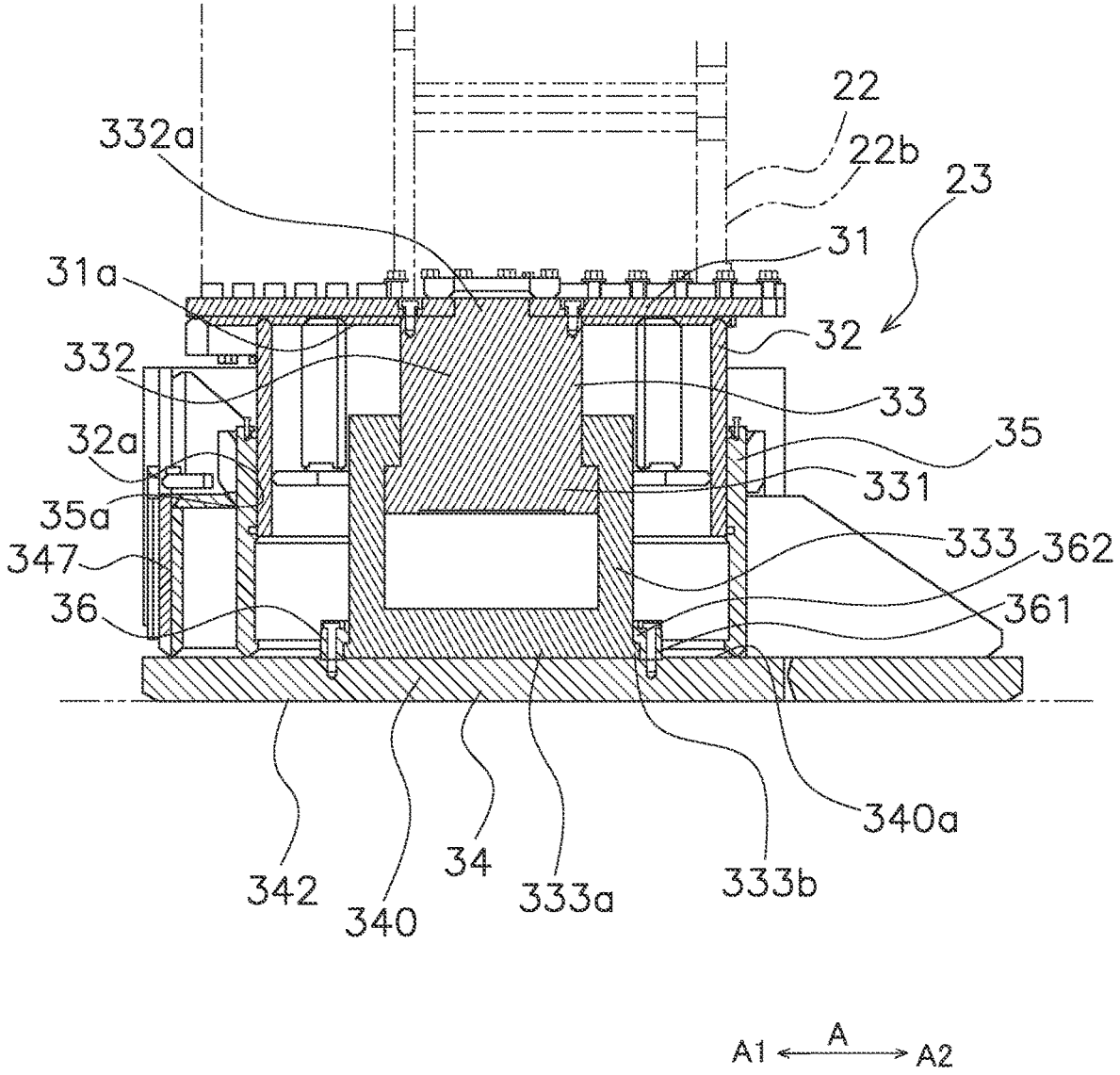
FIG. 6 is a cross-sectional view between arrows D and D' in FIG. 4.

FIG. 4 is a front view illustrating the vertical support 23 as seen from the front. FIG. 5 is a plan view of the vertical support 23 and the portion enclosed in the chain line is a cross-sectional view between arrows C and C' in FIG. 4. FIG. 6 is a cross-sectional view between arrows D and D' in FIG. 4.

As illustrated in FIG. 6, the vertical support 23 has an attachment member 31, a guide 32, a hydraulic cylinder 33, a vertical shoe 34, and an outer circumferential section 35.

The attachment member 31 has a plate shape and is fixed to a lower section 22*d* of the cutter head support 22 with bolts as illustrated in FIG. 4.

The guide 32 has a cylindrical shape and is disposed on a lower surface 31*a* of the attachment member 31 as illustrated in FIG. 6. The guide 32 is fixed to the attachment member 31. The guide 32 is disposed so that the center axis thereof is perpendicular to the attachment member 31. The attachment member 31 and the guide 32 are fixed to the cutter head support 22.

The hydraulic cylinder 33 is disposed on the lower side of the attachment member 31 and is fixed to the attachment member 31 as illustrated in FIG. 6. The hydraulic cylinder 33 is able to expand and contract in the up-down direction. The hydraulic cylinder 33 has a piston 331, a rod 332, and a cylinder 333. The piston 331 is disposed inside the cylinder 333 so as to be able to move in the up-down direction. The rod 332 extends upward from the piston 331. A tip end 332*a* of the rod 332 is fixed to the attachment member 31. A lower end 333*a* of the cylinder 333 is rotatably engaged with the vertical shoe 34. The hydraulic cylinder 33 is provided in the center of the cylindrical guide 32. That is, the hydraulic cylinder 33 is disposed so that the center axis of the guide 32 matches the center axis of the rod 332 of the hydraulic cylinder 33.

The vertical shoe 34 is able to slide on the ground surface of the tunnel. The vertical shoe 34 has a frame section 340, a sliding surface 341, and a cover 347 as illustrated in FIG. 3.

The lower end 333*a* of the cylinder 333 of the hydraulic cylinder 33 is rotatably engaged with the frame section 340. The cylinder 333 has an edge section 333*b* that protrudes to the outside at the lower end 333*a*. The edge section 333*b* is formed along the entire circumference of the cylinder 333.

An annular engagement member 36 for rotatably engaging with the edge section 333*b* is fixed with bolts, etc., to an upper surface 340*a* of the frame section 340. The engagement member 36 has an outer edge section 361 positioned outside of the edge section 333*b*, and an eave section 362 that covers the upper part of the edge section 333*b*. Consequently, the frame section 340 can turn with respect to the cylinder 333.

The sliding surface 341 is provided so as to surround the outside of the frame section 340. The sliding surface 341 is formed in an arc shape that protrudes downward as seen in the front view in FIG. 4. The sliding surface 341 is formed horizontally in a side surface cross-section.

The sliding surface 341 is divided into three sections in the width direction and has a center surface 342, a left side surface 343, and a right side surface 344. The center surface 342 is positioned in the center in the width direction of the sliding surface 341. The left side surface 343 is disposed on the left side of the center surface 342 facing the forward direction A1. The right side surface 344 is disposed on the right side of the center surface 342 facing the forward direction A1. A recessed section 345 is formed along the front-back direction A between the center surface 342 and the left side surface 343. Additionally, a recessed section 346 is formed along the front-back direction A between the center surface 342 and the right side surface 344.

A cover 347 blocks rocks and the like from hitting the guide 32 from the front. The cover 347 is provided on the front side of the outer circumferential section 35 and the guide 32, etc. The cover 347 is fixed to the frame section 340 and is provided on the upper side of the sliding surface 341 along the front end of the sliding surface 341.

The outer circumferential section 35 is disposed outside of the guide 32. The outer circumferential section 35 has a cylindrical portion and the cylindrical portion is disposed outside of the guide 32 as illustrated in FIG. 5. An outer circumferential surface 32*a* of the guide 32 is able to slide with an inner circumferential surface 35*a* of the cylindrical portion of the outer circumferential section 35. The outer circumferential section 35 is fixed to the upper surface 340*a* of the frame section 340.

Figure 7:
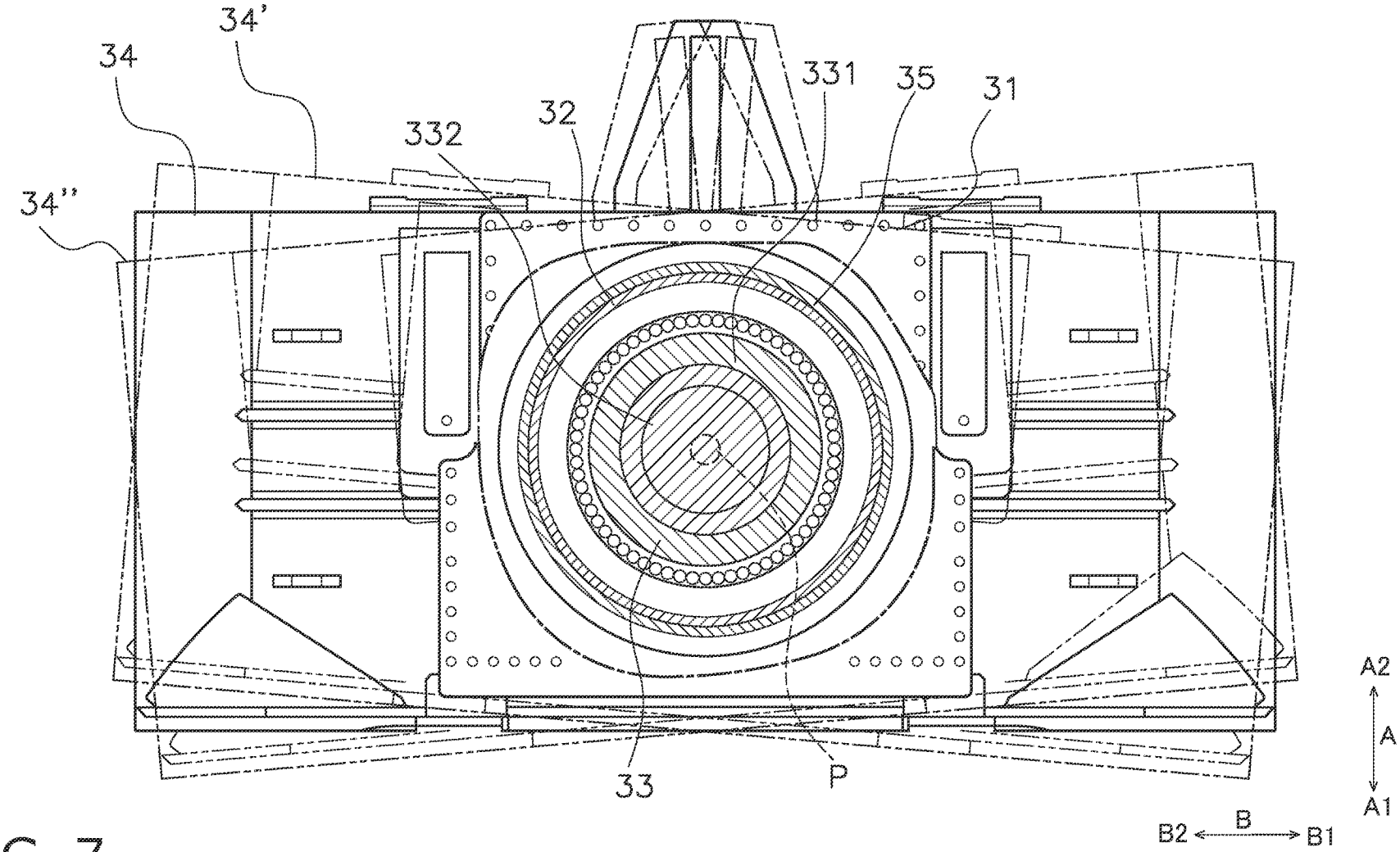
FIG. 7 is a plan view illustrating turning of the vertical shoe of the vertical support in FIG. 3.
Figure 8:
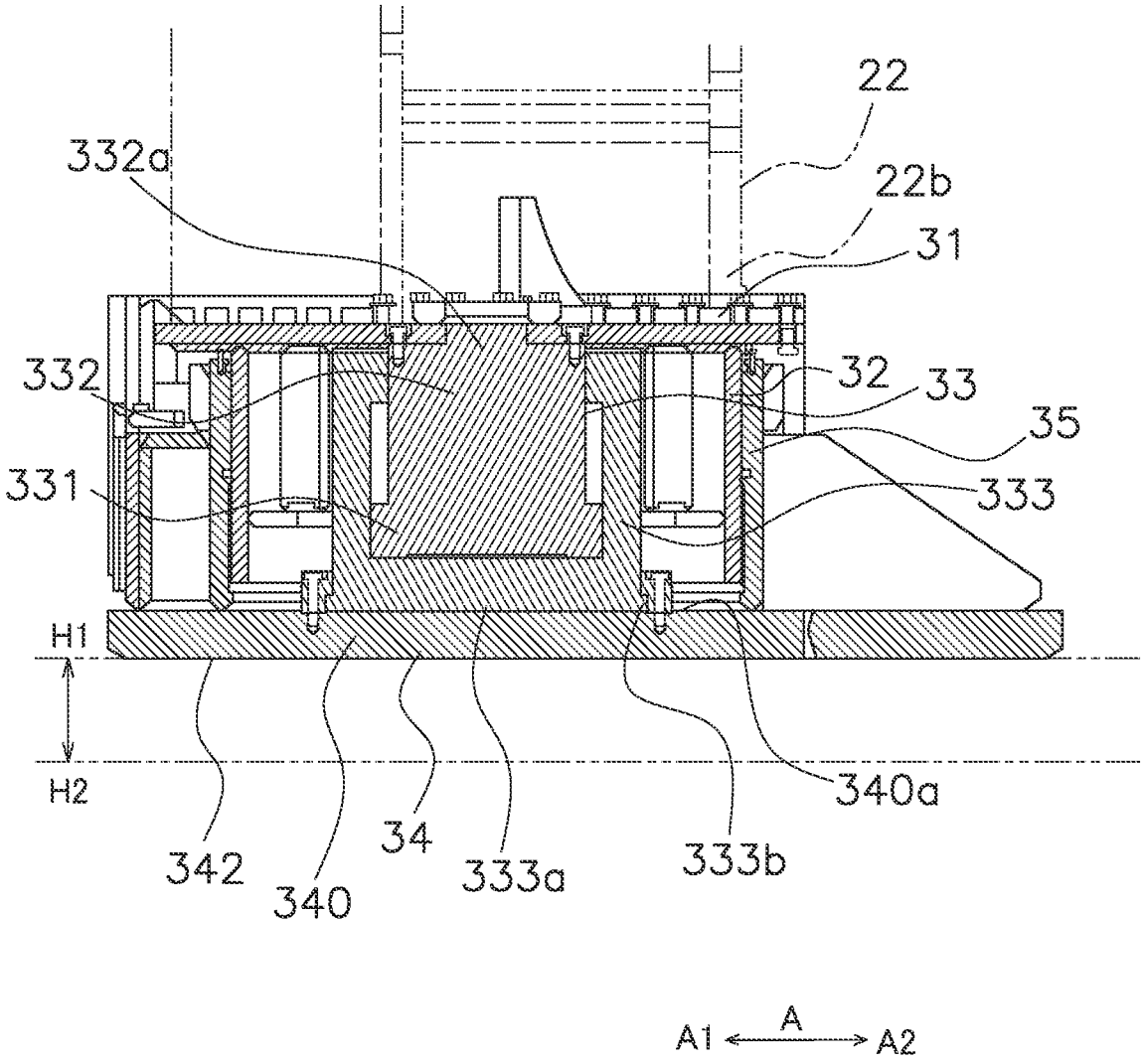
FIG. 8 is a diagram illustrating a state in which the vertical shoe in FIG. 6 approaches the cutter head support.

The vertical shoe 34 is engaged with the hydraulic cylinder 33 in a turnable manner and the hydraulic cylinder 33 is fixed to the attachment member 31 to the cutter head support 22 whereby the vertical shoe 34 is able to turn around the center axis P of the hydraulic cylinder 33 as illustrated in FIG. 7. In FIG. 7, the state of the vertical shoe 34 turned clockwise in a plan view is depicted with 34', and the state of the vertical shoe 34 turned anticlockwise in a plan view is depicted with 34". Consequently, the vertical shoe 34 is able to turn and follow a curve when performing the curve construction In addition, because the vertical shoe 34 is attached to the cutter head support 22 via the hydraulic cylinder 33, the vertical shoe 34 is able to move closer (move upward) to the cutter head support 22 due to the contraction of the hydraulic cylinder 33 as illustrated in FIG. 8 (see H1 in FIG. 8). In addition, the vertical shoe 34 is able to move away from (move downward) the cutter head support 22 due to the extension of the hydraulic cylinder 33 (see H2 in FIG. 8).

(Side Supports 24, 25)

The side supports 24 and 25 are disposed on either side in the width direction of the cutter head support 22 as illustrated in FIG. 2. The side support 24 is disposed on the B1 direction side of the cutter head support 22 and the side support 25 is disposed on the B2 direction side of the cutter head support 22.

Each of the side supports 24 and 25 have a side shoe 41, a side shoe coupling section 42, a parallel link 43, and hydraulic cylinders 44.

The side support 24 and the side support 25 are disposed symmetrically while sandwiching the cutter head support 22 and have the same configurations and, therefore, the side support 24 will be used in the explanation.

Figure 9A:
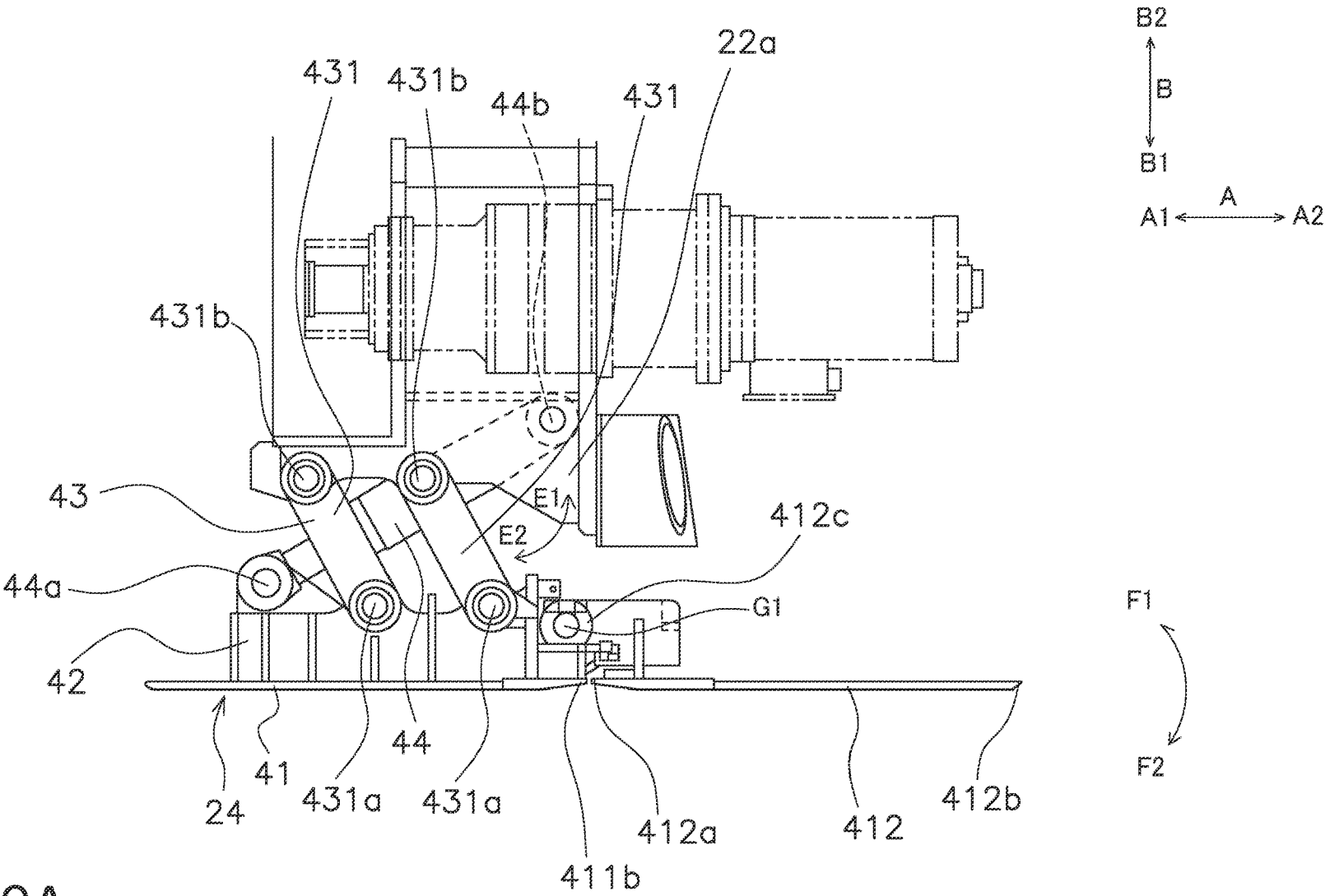
FIG. 9A is an enlargement of a side support in FIG. 2.
Figure 9B:
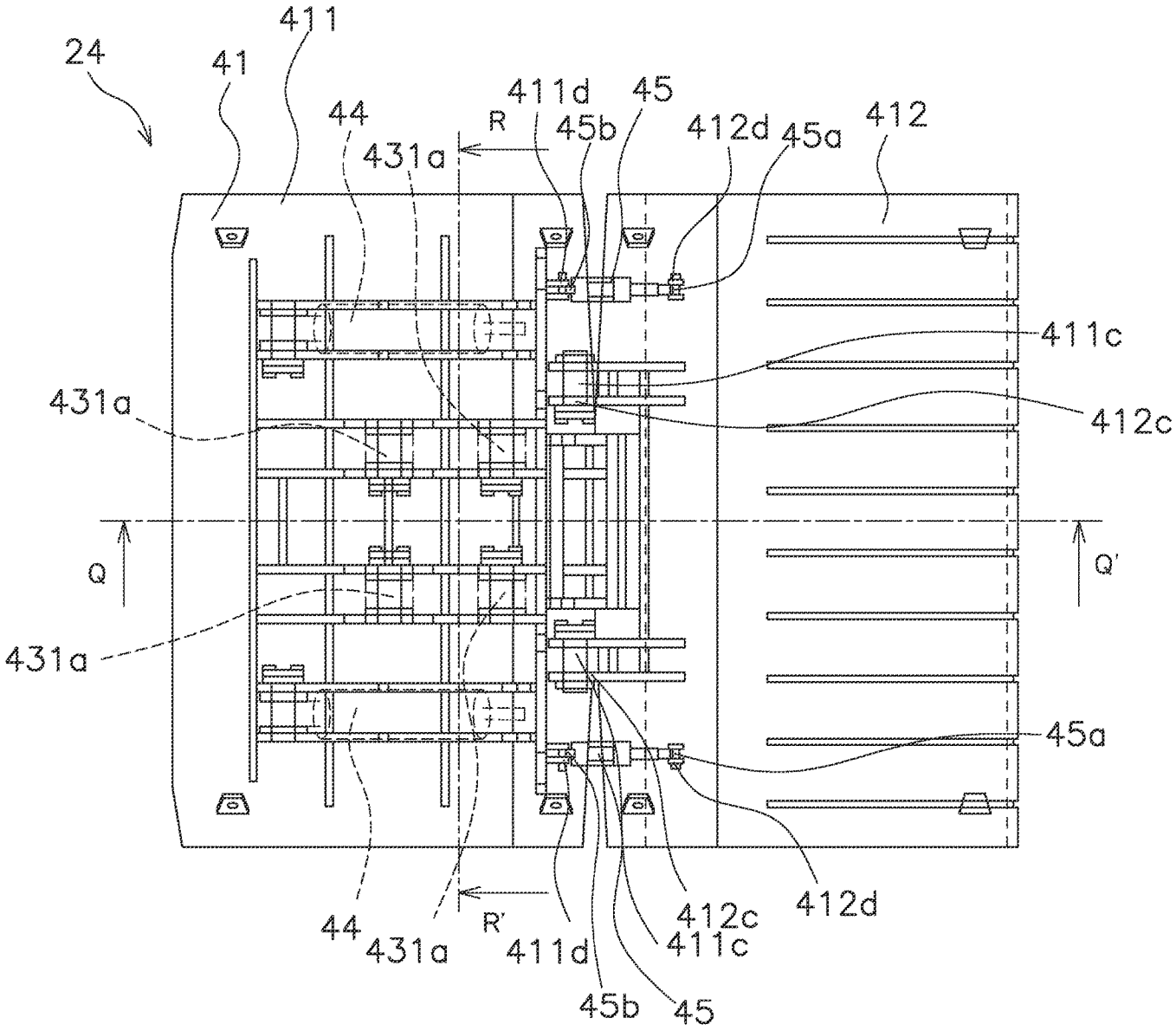
FIG. 9B is a rear view of the side support in FIG. 2.
Figure 9C:
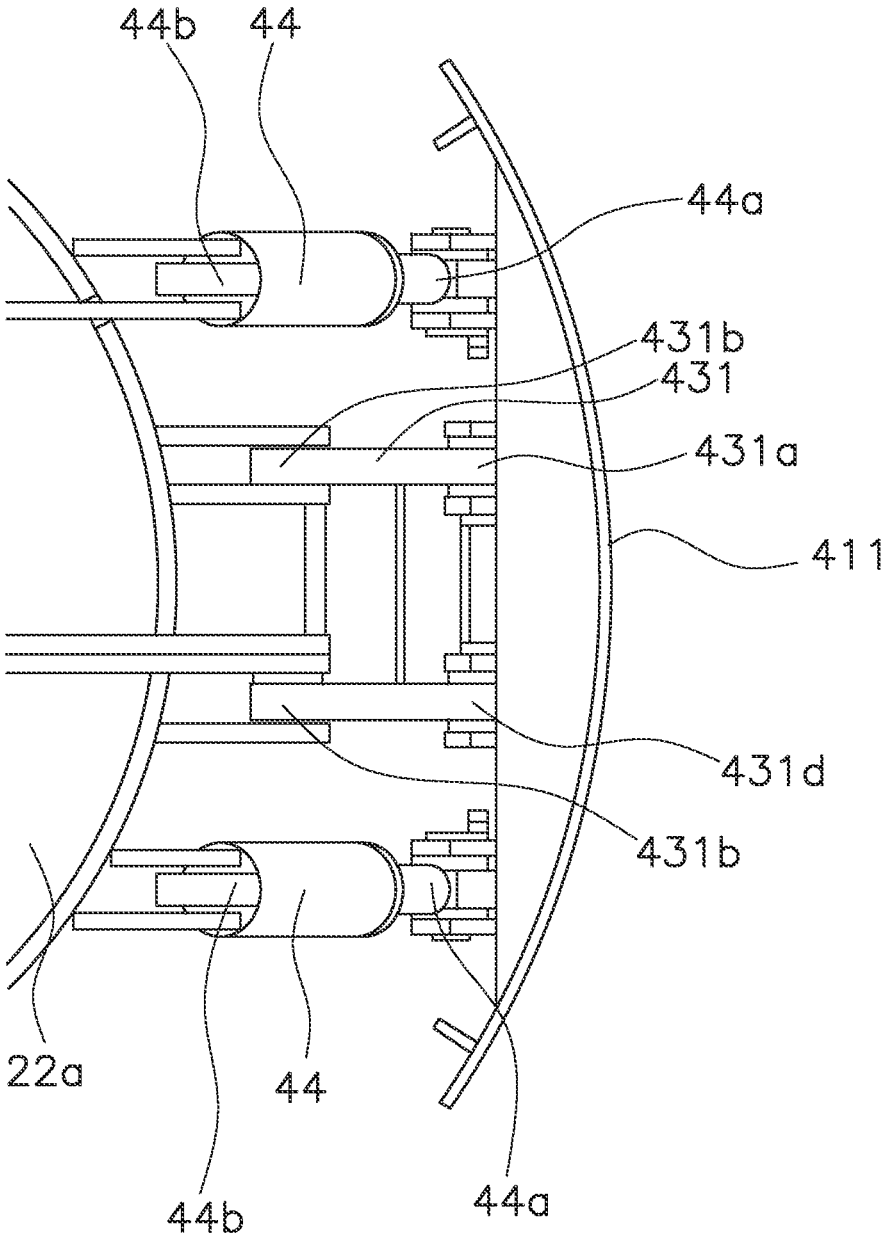
FIG. 9C is a cross-sectional view between arrows Q and Q' in FIG. 9B.

FIG. 9A is an enlargement in the vicinity of the side support 24 in FIG. 2. FIG. 9B is a rear view of the side support 24. FIG. 9A is an arrow cross-sectional view between Q and Q' in FIG. 9B. FIG. 9C is an arrow cross-sectional view between R and R' in FIG. 9B.

The side shoe 41 is disposed so as to cover the left side of the cutter head support 22 as illustrated in FIG. 1A and FIG. 2. The side shoe 41 is curved to protrude outward as seen along the front-back direction A.

The side shoe coupling section 42 is disposed on the cutter head support 22 side of the side shoe 41 as illustrated in FIG. 9A. The side shoe coupling section 42 is a portion for coupling with the cutter head support 22. A side section 22*a* of the cutter head support 22 is coupled to the side shoe coupling section 42 through the parallel link 43.

The parallel link 43 has two parallel coupling members 431. The two coupling members 431 are disposed side by side in the front-back direction A. Each coupling member 431 is disposed substantially horizontally. The coupling members 431 form an H-shape as seen in the front view as illustrated in FIG. 9C. A first end 431*a* of each coupling member 431 is rotatably attached to the side shoe coupling section 42 and a second end 431*b* of each coupling member 431 is rotatably attached to the side section 22*a*. The second end 431*b* of each of the coupling members 431 is disposed further toward the front than the first end 431*a*.

The hydraulic cylinders 44 are disposed substantially horizontally. In FIG. 9B, the outer shape of the hydraulic cylinders 44 are illustrated with dashed lines. The hydraulic cylinders 44 are disposed on the upper side and lower side of the parallel link 43. The hydraulic cylinders 44 each have a cylinder and a rod that is connected to a piston disposed inside the cylinder. A first end 44*a* on the rod side is turnably attached to the side shoe coupling section 42. A second end 44*b* on the cylinder side is attached to the side section 22*a* in a turnable manner. The first end 44*a* is disposed further toward the front than the second end 44*b*. Rotating shafts of the first end 44*a* and the second end 44*b* of each hydraulic cylinder 44 are parallel to the vertical direction. In addition, the hydraulic cylinders 44 are disposed so as to intersect the parallel link 43 as seen in a plan view.

Figure 9D:
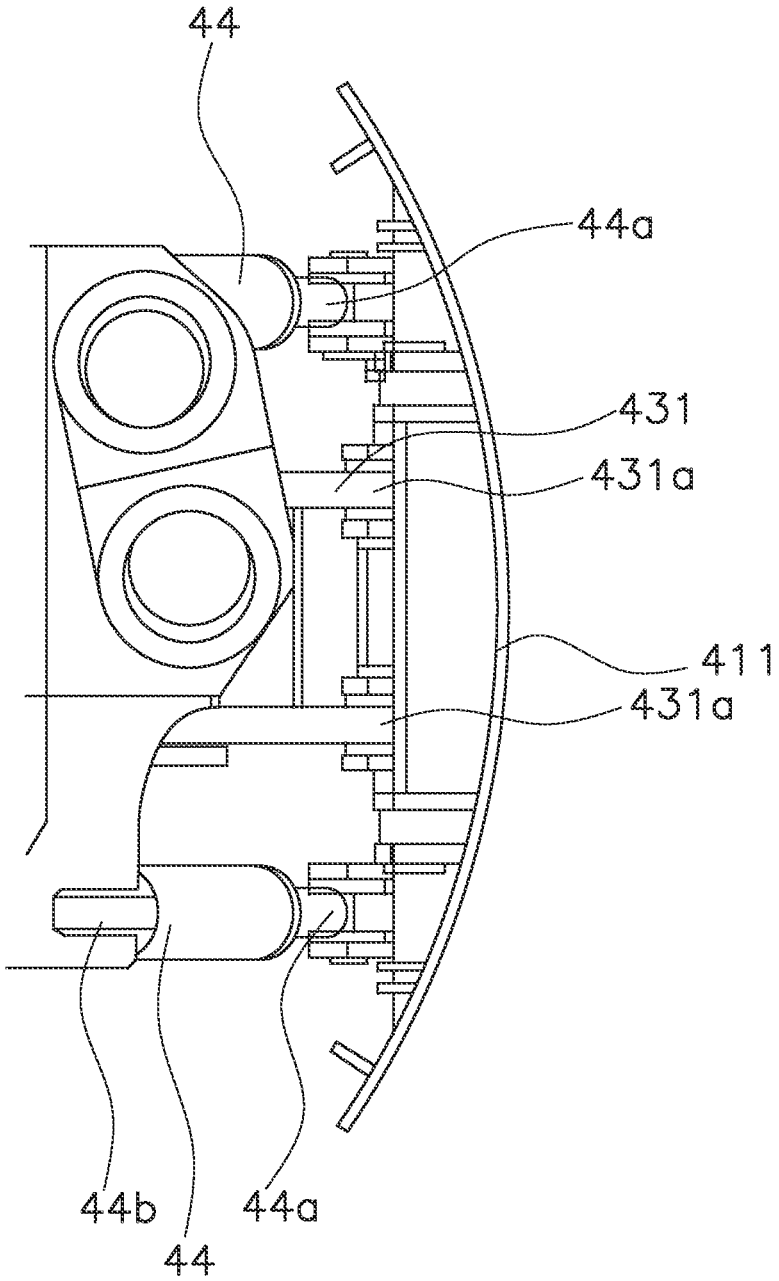
FIG. 9D is a cross-sectional view between arrows R and R' in FIG. 9B.

When the hydraulic cylinders 44 contract, the first ends 431*a* of the coupling members 431 of the parallel link 43 turn toward the side section 22*a* side about the second ends 431*b* (see arrow E1). Consequently, the side shoe 41 moves to the cutter head support 22 side and the diameter of the front body section 11 can be reduced as illustrated in FIG. 9D. FIG. 9D is an arrow cross-sectional view between R and R' in FIG. 9B.

Moreover, when the hydraulic cylinders 44 extend, the first ends 431*a* of the coupling members 431 of the parallel link 43 turn away from the side section 22*a* about the second ends 431*b* (see arrow E2). Consequently, the side shoe 41 moves away from the cutter head support 22 side and the diameter can be increased.

(Side Shoe 41)

The side shoe 41 has a side shoe front section 411 and a side shoe rear section 412 as illustrated in FIG. 9A and FIG. 9B. The side shoe coupling section 42 is provided to the side shoe front section 411. The side shoe rear section 412 is disposed to the rear of the side shoe front section 411. The side shoe rear section 412 is configured so that a rear end 412*b* is able to turn horizontally (see arrows F1 and F2) about coupling sections 412*c* coupled to a rear end 411*b* of the side shoe front section 411. In the present description, the horizontal direction, the up-down direction, the vertical direction, the front-back direction, the width direction, parallel, etc. are not strict meanings and may include tolerances and may be recognized as the socially-acceptable meanings.

A coupling section 411*c* is provided on the inside to the rear end 411*b* of the side shoe front section 411. Two coupling sections 411*c* are provided as illustrated in FIG. 9B and are disposed vertically. Two coupling sections 412*c* are provided on the inside to the front end 412*a* of the side shoe rear section 412, and each of the coupling sections 411*c* and the coupling sections 412*c* are formed with through-holes in the vertical direction and a shaft member is inserted into each of the through-holes. Consequently, the side shoe rear section 412 is able to turn with respect to the side shoe front section 411. In FIG. 9A, the coupling shaft in the up-down direction is depicted as G1. A plurality of notches are formed in the side shoe rear section 412 from the rear end 412*b* thereof in the forward direction A1 as illustrated in FIG. 1A.

Hydraulic cylinders 45 for turning the rear end 412*b* of the side shoe rear section 412 about the coupling shaft G1 are disposed extending from the side shoe front section 411 to the side shoe rear section 412. Two hydraulic cylinders 45 are disposed so as to sandwich the two coupling sections 411*c* and 412*c* from above and below as illustrated in FIG. 9B.

The hydraulic cylinders 45 are disposed substantially horizontally. The hydraulic cylinders 45 each have a cylinder and a rod that is connected to a piston disposed inside the cylinder. Coupling sections 412*d* are provided on the inside near the front end 412*a* of the side shoe rear section 412. A first end 45*a* on the rod side of each hydraulic cylinder 45 is rotatably attached to each coupling section 412*d*.

In addition, coupling sections 411*d* are provided on the inside near the rear end 411*b* of the side shoe front section 411. The coupling sections 411*d* are overlapped by the coupling sections 411*c* as seen in a plan view. A second end 45*b* on the cylinder side of each hydraulic cylinder 45 is rotatably attached to each coupling section 411*d*. Turning centers of the first end 45*a* and the second end 45*b* of each hydraulic cylinder 45 are approximately parallel to the vertical direction.

When the hydraulic cylinders 45 contract, the coupling sections 412*d* coupled to the first ends 45*a* turn toward the arrow F1 and therefore the rear end 412*b* of the side shoe rear section 412 turns in the direction of the arrow F1 about the coupling shaft G1. Consequently, the rear end 412*b* of the side shoe rear section 412 is able to move to the inside (in the direction approaching the cutter head support 22).

When the hydraulic cylinders 45 extend, the coupling sections 412*c* coupled to the first ends 45*a* turn toward the arrow F2 and therefore the rear end 412*b* of the side shoe rear section 412 turns in the direction of the arrow F2 about the coupling shaft G1. Consequently, the rear end 412*b* of the side shoe rear section 412 is able to move to the outside (in the direction away from the cutter head support 22).

(Roof Support 26)

The roof support 26 is disposed above the cutter head support 22.

Figure 10:
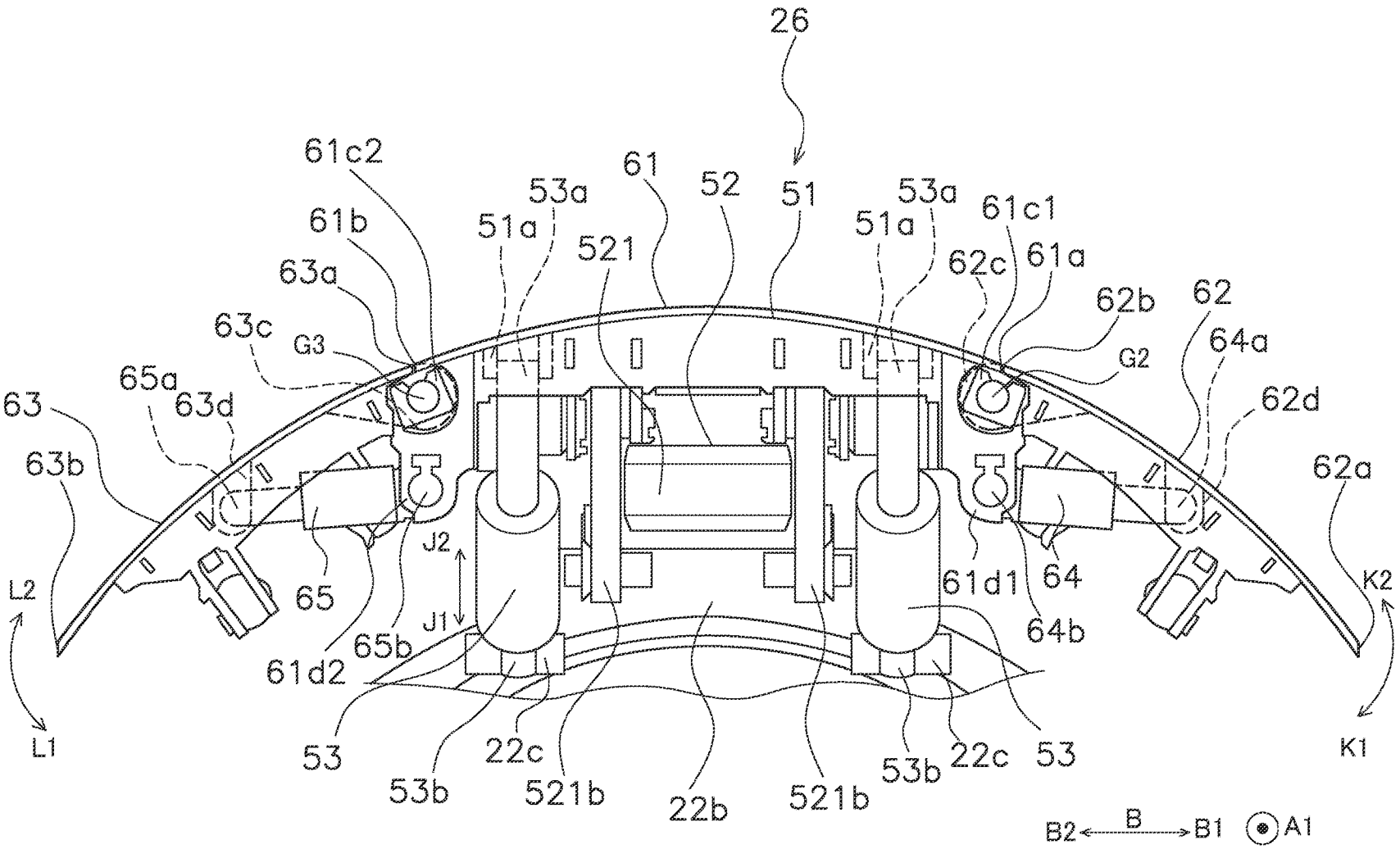
FIG. 10 is a front view of a roof support in FIG. 1A.
Figure 11A:
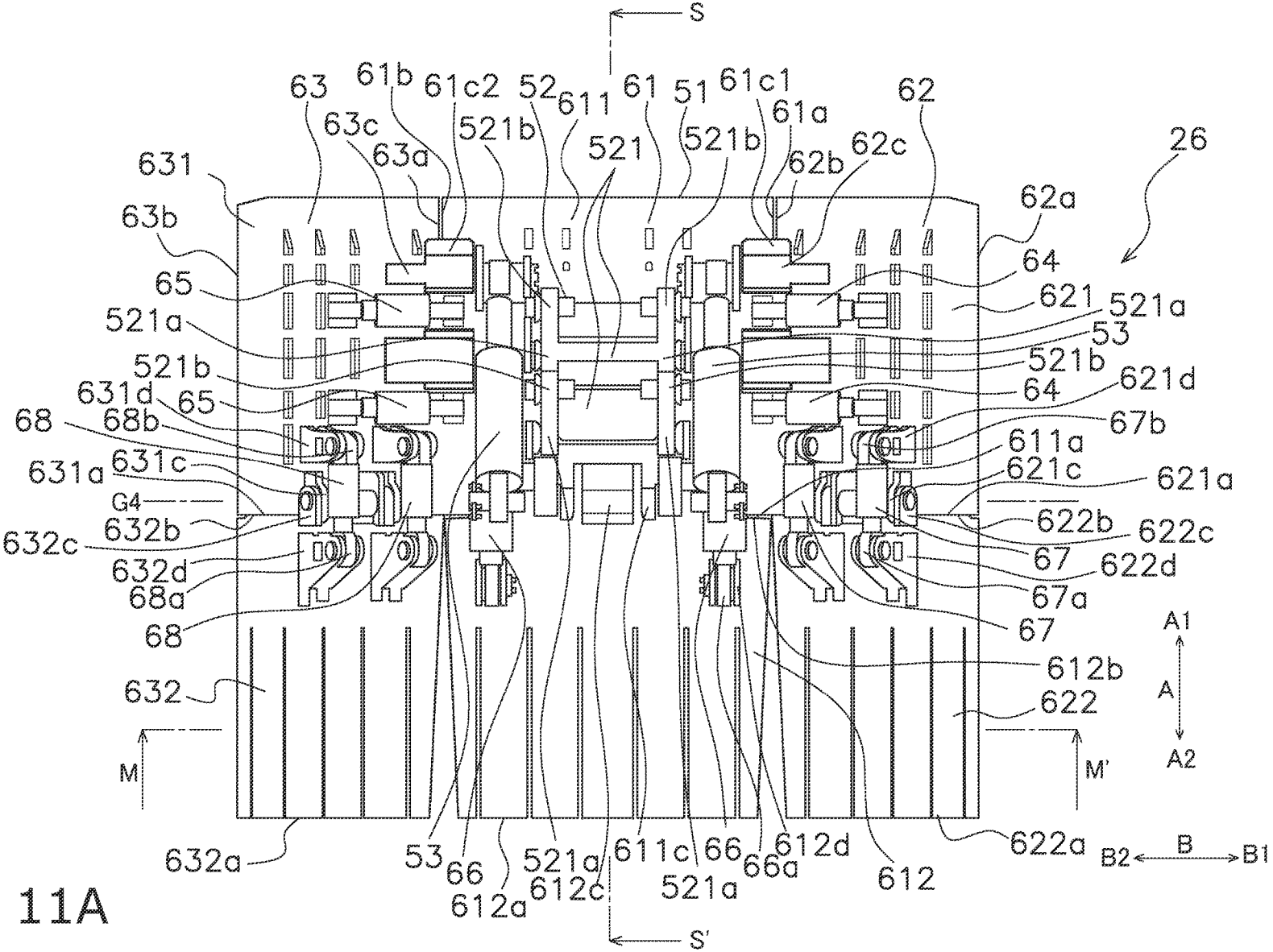
FIG. 11A is a bottom surface view of the roof support in FIG. 10.
Figure 11B:
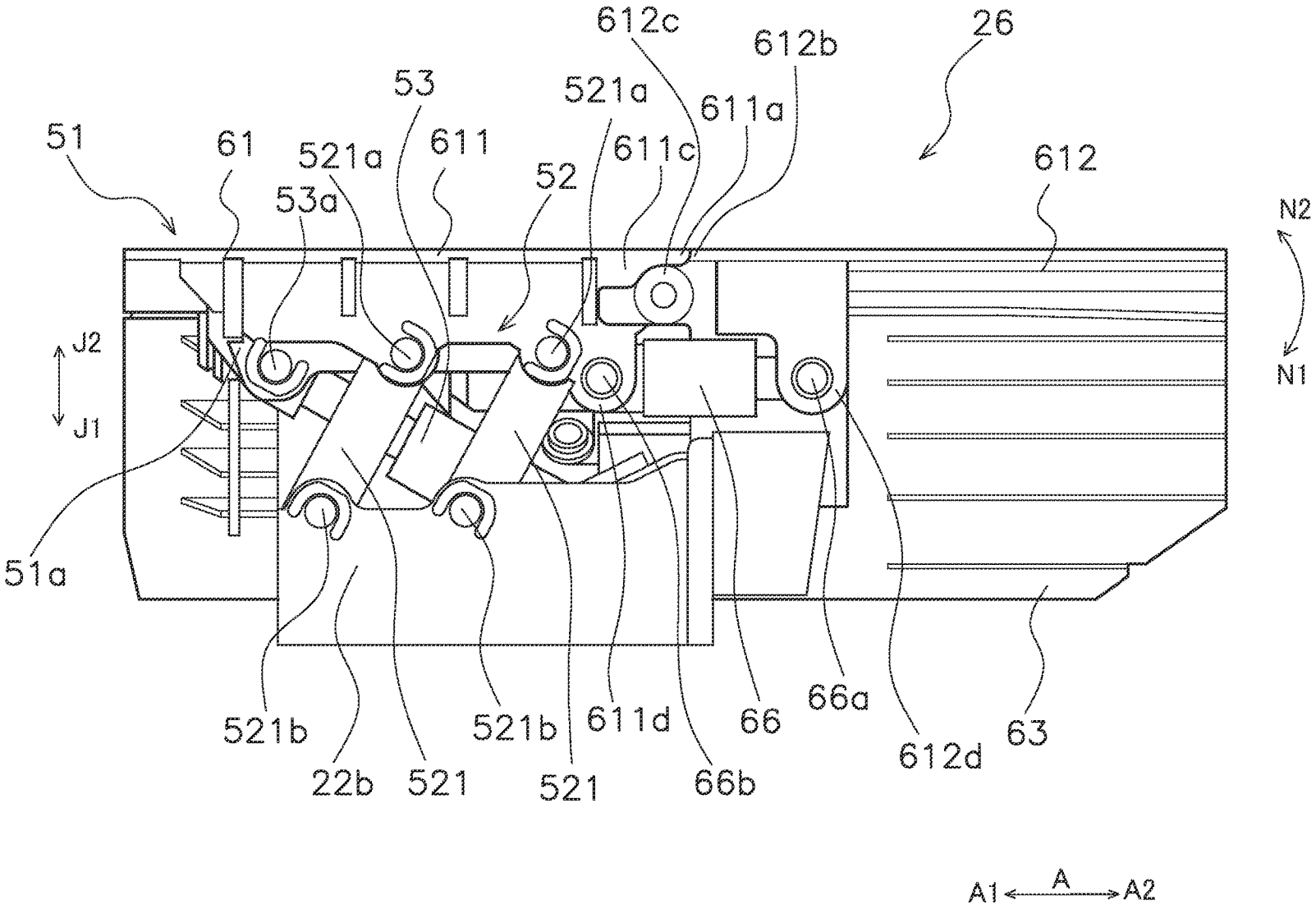
FIG. 11B is a cross-sectional view between arrows S and S' in FIG. 11A.
Figure 12:
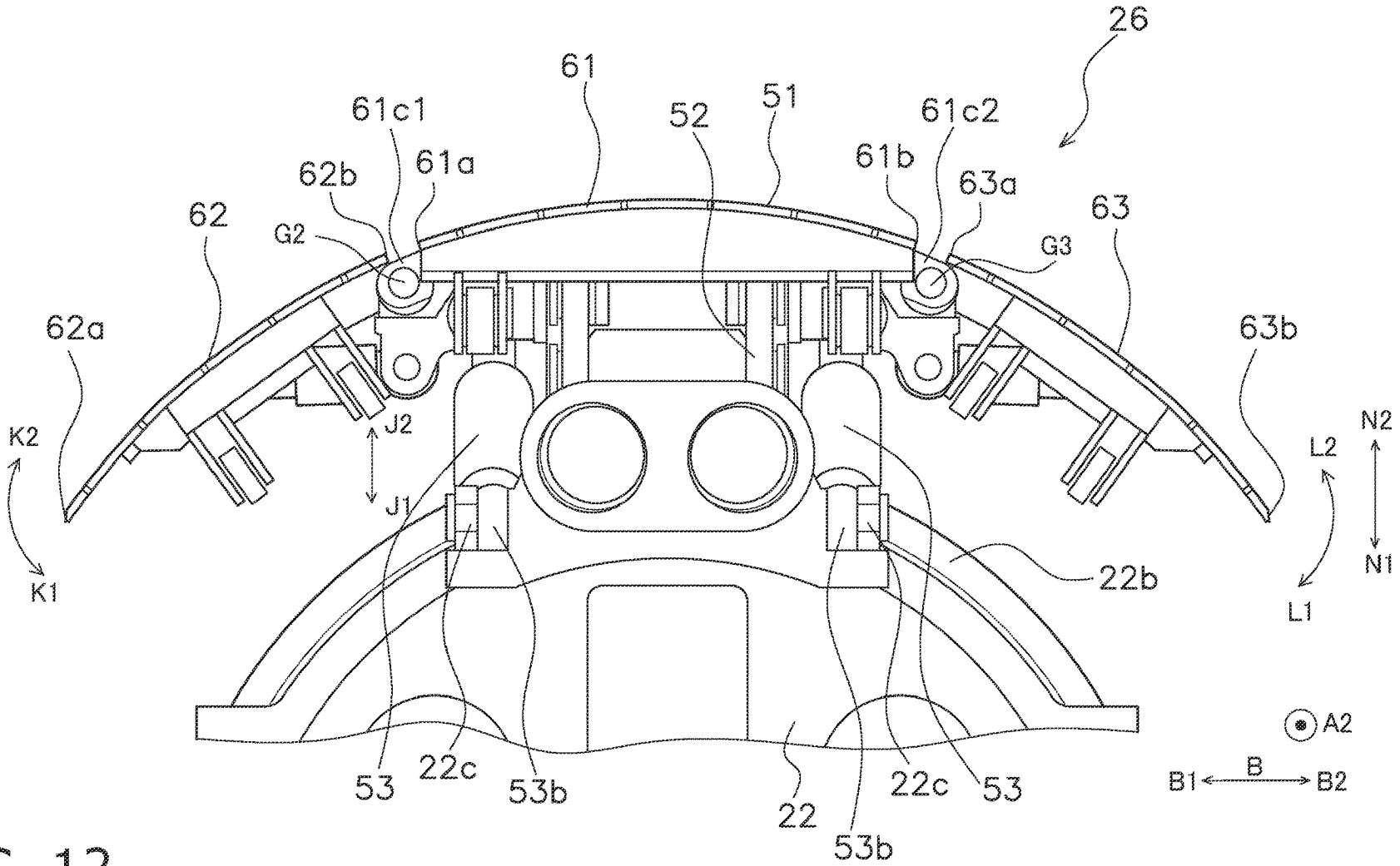
FIG. 12 is a cross-sectional view between arrows M and M' in FIG. 11A.

FIG. 10 is a front view of the roof support 26 as seen from the front. FIG. 11A is a bottom view of the roof support 26. FIG. 11B is a cross-sectional view between arrows S and S' in FIG. 11A. FIG. 12 is a cross-sectional view between arrows M and M' in FIG. 11A.

The roof support 26 has a roof shoe 51, a parallel link 52, and hydraulic cylinders 53 as illustrated in FIG. 10.

The roof shoe 51 is disposed so as to cover the cutter head support 22 from above as illustrated in FIG. 1A and FIG. 2. The roof shoe 51 is curved to protrude outward as seen along the front-back direction A. The above-mentioned vertical shoe 34 of the vertical support 23, the side shoe 41 of the side support 24, the side shoe 41 of the side support 25, and the roof shoe 51 are disposed so as to form a circle as seen along the front-back direction A.

The parallel link 52 couples the roof shoe 51 and an upper section 22*b* of the cutter head support 22. The parallel link 52 has two coupling members 521 as illustrated in FIG. 11A and FIG. 11B. The two coupling members 521 are disposed along the front-back direction A. Each of the coupling members 521 forms an H shape as seen from the front. Two first ends 521*a* on the upper ends of the H shape of each coupling member 521 are turnably attached to the roof shoe 51. Two second ends 521*b* that are the lower ends of the H shape of each coupling member 521 are turnably coupled to the upper section 22*b* of the cutter head support 22. A turning shaft in each of the first ends 521*a* and the second ends 521*b* of each coupling member 521 is provided in the B direction. The second ends 521*b* of each of the coupling members 521 are disposed further toward the front than the first ends 521*a*.

The hydraulic cylinders 53 move the roof shoe 51 in a direction approaching the cutter head support 22 or in a direction away from the cutter head support 22. Two hydraulic cylinders 53 are provided and are disposed at both outer sides in the width direction B of the parallel link 52. Each of the hydraulic cylinders 53 is disposed approximately parallel to a vertical plane. The hydraulic cylinders 53 each have a cylinder and a rod that is connected to a piston disposed inside the cylinder.

Coupling sections 51*a* are provided inside the roof shoe 51 as illustrated in FIG. 10 and a first end 53*a* on the rod side of each hydraulic cylinder 53 is rotatably attached to the coupling section 51*a*. Coupling sections 22*c* are provided to the upper section 22*b* of the cutter head support 22 and a second end 53*b* on the cylinder side of each hydraulic cylinder 53 is rotatably attached to the coupling section 22*c*. The first ends 53*a* are disposed further toward the front than the second ends 53*b*. Rotating shafts of the first end 53*a* and the second end 53*b* of each hydraulic cylinder 53 are parallel to the width direction B. In addition, the hydraulic cylinders 53 are disposed so as to intersect the parallel link 52 as seen in a side view.

When the hydraulic cylinders 53 contract, the first ends 521*a* of the coupling members 521 of the parallel link 52 turn about the second ends 521*b* toward the upper section 22*b* (see arrow J1 in FIG. 10). Consequently, the roof shoe 51 moves to the cutter head support 22 side and the diameter of the front body section 11 can be reduced.

Moreover, when the hydraulic cylinders 53 contract, the first ends 521*a* of the coupling members 521 of the parallel link 52 turn about the second ends 521*b* away from the upper section 22*b* (see arrow J2). Consequently, the roof shoe 51 moves away from the cutter head support 22 side and the diameter can be increased.

(Roof Shoe 51)

The roof shoe 51 has a roof shoe center section 61, a roof shoe left side section 62, a roof shoe right side section 63, hydraulic cylinders 64, and hydraulic cylinders 65 as illustrated in FIG. 10 and FIG. 11A. The roof shoe center section 61 is disposed in the center in the width direction B of the roof shoe 51. The parallel link 52 and the hydraulic cylinder 64 are coupled to the roof shoe center section 61.

The roof shoe left side section 62 is disposed on the left side (B1 direction side) of the roof shoe center section 61. A right end 62*b* of the roof shoe left side section 62 is coupled to the left end 61*a* of the roof shoe center section 61. The roof shoe left side section 62 is configured so that a left end 62*a* is able to turn in the up-down direction about a coupling section 62*c* with the roof shoe center section 61 (see arrows K1 and K2).

A coupling section 61*c*1 is provided on the inside to the left end 61*a* of the roof shoe center section 61. The coupling section 62*c* is provided on the inside to the right end 62*b* of the roof shoe left side section 62. The coupling section 61*c*1 and the coupling section 62*c* are each formed with a through-hole along the front-back direction A, and a shaft member is inserted into each of the through-holes. Consequently, the left end 62*a* of the roof shoe left side section 62 is able to turn about a coupling shaft G2 along the front-back direction A in a direction approaching (arrow K1) and a direction away from (arrow K2) the cutter head support 22 with respect to the roof shoe center section 61.

The hydraulic cylinders 64 are disposed straddling the roof shoe center section 61 and the roof shoe left side section 62. As illustrated in FIG. 11A, two hydraulic cylinders 64 are disposed side by side in the front-back direction A. The hydraulic cylinders 64 are each disposed along the width direction B. The hydraulic cylinders 64 each have a cylinder and a rod that is connected to a piston disposed inside the cylinder. As illustrated in FIG. 10, coupling sections 62*d* are provided near the center in the width direction B of the roof shoe left side section 62 and a first end 64*a* on the rod side of each hydraulic cylinder 64 is turnably attached to the coupling section 62*d*. Coupling sections 61*d*1 are provided inside near the left end 61*a* of the roof shoe center section 61, and a second end 64*b* on the cylinder side of each hydraulic cylinder 64 is rotatably attached to the coupling section 61*d*1. The first end 64*a* and the second end 64*b* of each hydraulic cylinder 64 are able to turn about an axis in the front-back direction A.

When the hydraulic cylinders 64 contract, the coupling section 62*d* coupled to the first end 64*a* turns toward the arrow K1 in FIG. 10 whereby the left end 62*a* of the roof shoe left side section 62 turns in the direction of the arrow K1 about the coupling shaft G2. Consequently, the left end 62*a* of the roof shoe left side section 62 is able to move to the inside (in the direction approaching the cutter head support 22).

When the hydraulic cylinders 64 extend, the coupling section 62*d* coupled to the first end 64*a* turns in the direction of the arrow K2 whereby the left end 62*a* of the roof shoe left side section 62 turns in the direction of the arrow K2 about the coupling shaft G2. Consequently, the left end 62*a* of the roof shoe left side section 62 is able to move to the outside (in the direction away from the cutter head support 22).

The roof shoe right side section 63 is disposed on the right side (B2 direction side) of the roof shoe center section 61. A right end 61*b* of the roof shoe center section 61 is coupled to a left end 63*a* of the roof shoe right side section 63. The roof shoe right side section 63 is configured so that a right end 63*b* is able to turn in the up-down direction about a coupling section 63*c* with the roof shoe center section 61 (see arrows L1 and L2).

A coupling section 61*c*2 is provided on the inside to the right end 61*b* of the roof shoe center section 61. The coupling section 63*c* is provided on the inside to the left end 63*a* of the roof shoe right side section 63. The coupling section 61*c*2 and the coupling section 63*c* are each formed with a through-hole along the front-back direction A, and a shaft member is inserted into each of the through-holes. Consequently, the right end 63*b* of the roof shoe right side section 63 is able to turn about a coupling shaft G3 along the front-back direction A in a direction approaching (arrow L1) and a direction away from (arrow L2) the cutter head support 22 with respect to the roof shoe center section 61.

The hydraulic cylinders 65 are disposed straddling the roof shoe center section 61 and the roof shoe right side section 63. As illustrated in FIG. 11A, two hydraulic cylinders 65 are disposed side by side in the front-back direction A. The hydraulic cylinders 65 are each disposed along the width direction B. The hydraulic cylinders 65 each have a cylinder and a rod that is connected to a piston disposed inside the cylinder. Coupling sections 63*d* are provided near the center in the width direction B of the roof shoe right side section 63, and a first end 65*a* on the rod side of each hydraulic cylinder 65 is rotatably attached to the coupling section 63*d*. Coupling sections 61*d*2 are provided on the inside near the right end 61*b* of the roof shoe center section 61 and the second end 65*b* on the cylinder side of each hydraulic cylinder 65 is rotatably attached to the coupling section 61*d*2. The first end 65*a* and the second end 65*b* of each hydraulic cylinder 65 are able to turn about an axis in the front-back direction A.

When the hydraulic cylinders 65 contract, the coupling sections 63*d* coupled to the first ends 65*a* turn toward the arrow L1 and therefore the right end 63*b* of the roof shoe right side section 63 turns in the direction of the arrow L1 about the coupling shaft G3. Consequently, the right end 63*b* of the roof shoe right side section 63 is able to move to the inside (in the direction approaching the cutter head support 22).

When the hydraulic cylinders 65 extend, the coupling sections 63*d* coupled to the first ends 65*a* turn toward the arrow L2 and therefore the right end 63*b* of the roof shoe right side section 63 turns in the direction of the arrow L2 about the coupling shaft G3. Consequently, the right end 63*b* of the roof shoe right side section 63 is able to move to the outside (in the direction away from the cutter head support 22).

(Roof Shoe Center Section 61)

As illustrated in FIG. 11A and FIG. 11B, the roof shoe center section 61 has a roof shoe center front section 611 and a roof shoe center rear section 612.

The parallel link 52, the hydraulic cylinders 53, the hydraulic cylinders 64, and the hydraulic cylinders 65 are coupled to the roof shoe center front section 611. The roof shoe center rear section 612 is disposed to the rear of the roof shoe center front section 611. A rear end 611*a* of the roof shoe center front section 611 is coupled to a front end 612*b* of the roof shoe center rear section 612. The roof shoe center rear section 612 is configured so that a rear end 612*a* is able to turn in the up-down direction about a coupling section 612*c* with the roof shoe center front section 611 (toward the front and toward the back of the sheet in FIG. 11A and the directions of arrows N1 and N2 in FIG. 11B). A plurality of notches are formed in the roof shoe center rear section 612 from the rear end 612*a* thereof in the forward direction A1 as illustrated in FIG. 1A.

A coupling section 611*c* is provided on the inside to the rear end 611*a* of the roof shoe center front section 611. The coupling section 612*c* is provided on the inside to a front end 612*b* of the roof shoe center rear section 612. The coupling section 611*c* and the coupling section 612*c* are each formed with a through-hole along the width direction B, and a shaft member is inserted into each of the through-holes. Consequently, the rear end 612*a* of the roof shoe center rear section 612 is able to turn about a coupling shaft G4 in the width direction B in the direction approaching (see direction toward the front of the sheet in FIG. 11A and the direction of arrow N1 in FIG. 11B) and in the direction away from (see direction toward the back of the sheet in FIG. 11A and the direction of arrow N2 in FIG. 11B) the cutter head support 22.

In addition, hydraulic cylinders 66 are disposed straddling the roof shoe center front section 611 and the roof shoe center rear section 612 so that the rear end 612*a* of the roof shoe center rear section 612 turns about the coupling shaft G4.

Two hydraulic cylinders 66 are disposed along the width direction B. The hydraulic cylinders 66 are each disposed along the front-back direction A. The hydraulic cylinders 66 each have a cylinder and a rod that is connected to a piston disposed inside the cylinder. Coupling sections 612*d* are provided on the inside near the front end 612*b* of the roof shoe center rear section 612. A first end 66*a* on the rod side of each hydraulic cylinder 66 is rotatably attached to each coupling section 612*d*.

As illustrated in FIG. 11B, coupling sections 611*d* are provided inside near the rear end 611*a* of the roof shoe center front section 611, and a second end 66*b* on the cylinder side of each hydraulic cylinder 66 is turnably attached to the coupling section 611*d*. Turning centers of the first end 66*a* and the second end 66*b* of each hydraulic cylinder 66 are approximately parallel to the width direction B.

When the hydraulic cylinders 66 contract, the coupling section 612*d* coupled to the first end 66*a* turns in the direction toward the front of the sheet whereby the rear end 612*a* of the roof shoe center rear section 612 turns in the direction toward the front of the sheet about the shaft G4. Consequently, the rear end 612*a* of the roof shoe center rear section 612 is able to move to the inside (in the direction approaching the cutter head support 22) (see direction N1 in FIG. 11B and FIG. 12).

When the hydraulic cylinders 66 extend, because the coupling section 612*d* coupled to the first end 66*a* turns in the direction toward the back of the sheet, the rear end 612*a* of the roof shoe center rear section 612 turns in the direction toward the back of the sheet about the coupling shaft G4. Consequently, the rear end 612*a* of the roof shoe center rear section 612 is able to move to the outside (in the direction away from the cutter head support 22) (see direction N2 in FIG. 11B and FIG. 12).

(Roof Shoe Left Side Section 62)

The roof shoe left side section 62 has a roof shoe left side front section 621 and a roof shoe left side rear section 622 as illustrated in FIG. 11A.

The roof shoe left side front section 621 is coupled to the roof shoe center front section 611 and the hydraulic cylinders 64 are coupled to the roof shoe left side front section 621.

The roof shoe left side rear section 622 is disposed on the rear side of the roof shoe left side front section 621. A front end 622*b* of the roof shoe left side rear section 622 is coupled to a rear end 621*a* of the roof shoe left side front section 621. The roof shoe left side rear section 622 is configured so that a rear end 622*a* is able to turn in the up-down direction about the center of a coupling section 622*c* with the roof shoe left side front section 621 (toward the front of the sheet and toward the back of the sheet in FIG. 11A). A plurality of notches are formed in the roof shoe left side rear section 622 from the rear end 622*a* thereof in the forward direction A1 as illustrated in FIG. 1A.

A coupling section 621*c* is provided on the inside to the rear end 621*a* of the roof shoe left side front section 621. The coupling section 622*c* is provided on the inside to the front end 622*b* of the roof shoe left side rear section 622. The coupling section 621*c* and the coupling section 622*c* are each formed with a through-hole along the width direction B, and a shaft member is inserted into each of the through-holes. Consequently, the rear end 622*a* of the roof shoe left side rear section 622 is able to turn about the coupling shaft G4 in a direction approaching (direction toward the front of the sheet in FIG. 11A) and a direction away from (direction toward the back of the sheet in FIG. 11A) the cutter head support 22 with respect to the roof shoe left side front section 621.

In addition, hydraulic cylinders 67 for allowing the rear end 622*a* of the roof shoe left side rear section 622 to turn about the shaft G4 are disposed straddling the roof shoe left side front section 621 and the roof shoe left side rear section 622.

Two hydraulic cylinders 67 are disposed along the width direction B. The hydraulic cylinders 67 are each disposed along the front-back direction A. The hydraulic cylinders 67 each have a cylinder and a rod that is connected to a piston disposed inside the cylinder. Coupling sections 622*d* are provided on the inside near the front end 622*b* of the roof shoe left side rear section 622. A first end 67*a* on the rod side of each hydraulic cylinder 67 is turnably provided to each coupling section 622*d*.

In addition, coupling sections 621*d* are provided inside near the rear end 621*a* of the roof shoe left side front section 621, and a second end 67*b* on the cylinder side of each hydraulic cylinder 67 is rotatably attached to the coupling section 621*d*. Turning centers of the first end 67*a* and the second end 67*b* of each hydraulic cylinder 67 are approximately parallel to the width direction B.

When the hydraulic cylinders 67 contract, the coupling section 622*d* coupled to the first end 67*a* turns toward the front of the sheet whereby the rear end 622*a* of the roof shoe left side rear section 622 turns in the direction toward the front of the sheet about the shaft G4. Consequently, the rear end 622*a* of the roof shoe left side rear section 622 is able to move to the inside (in the direction approaching the cutter head support 22) (see direction N1 in FIG. 11B and FIG. 12).

When the hydraulic cylinders 67 extend, the coupling section 622*d* coupled to the first end 67*a* turns toward the back of the sheet whereby the rear end 622*a* of the roof shoe left side rear section 622 turns in the direction toward the back of the sheet about the coupling shaft G4. Consequently, the rear end 622*a* of the roof shoe left side rear section 622 is able to move to the outside (in the direction away from the cutter head support 22) (see direction N2 in FIG. 11B and FIG. 12).

(Roof Shoe Right Side Section 63)

The roof shoe right side section 63 has a roof shoe right side front section 631 and a roof shoe right side rear section 632 as illustrated in FIG. 11A.

The roof shoe right side front section 631 is coupled to the roof shoe center front section 611 and the hydraulic cylinders 65 are coupled to the roof shoe right side front section 631.

The roof shoe right side rear section 632 is disposed on the rear side of the roof shoe right side front section 631. A front end 632*b* of the roof shoe right side rear section 632 is coupled to a rear end 631*a* of the roof shoe right side front section 631. The roof shoe right side rear section 632 is configured so that a rear end 632*a* is able to turn in the up-down direction about a coupling section 632*c* with the roof shoe right side front section 631 (in the direction toward the front of the sheet and toward the back of the sheet in FIG. 11A). A plurality of notches are formed in the roof shoe right side rear section 632 from the rear end 632*a* thereof in the forward direction A1 as illustrated in FIG. 1A.

A coupling section 631*c* is provided on the inside to the rear end 631*a* of the roof shoe right side front section 631. The coupling section 632*c* is provided on the inside to the front end 632*b* of the roof shoe right side rear section 632.

The coupling section 631*c* and the coupling section 632*c* are each formed with a through-hole along the width direction B, and a shaft member is inserted into each of the through-holes. Consequently, the rear end 632*a* of the roof shoe right side rear section 632 is able to turn about the coupling axis G4 in a direction approaching (direction toward the front of the sheet in FIG. 11A) and a direction away from (direction toward the back of the sheet in FIG. 11A) the cutter head support 22 with respect to the roof shoe right side front section 631.

Hydraulic cylinders 68 for turning the rear end 632*a* of the roof shoe right side rear section 632 about the shaft G4 are disposed straddling the roof shoe right side front section 631 and the roof shoe right side rear section 632.

Two hydraulic cylinders 68 are disposed along the width direction B. The hydraulic cylinders 68 are each disposed along the front-back direction A. The hydraulic cylinders 68 each have a cylinder and a rod that is connected to a piston disposed inside the cylinder. A coupling section 632*d* is provided on the inside near the front end 632*b* of the roof shoe right side rear section 632. A first end 68*a* on the rod side of each hydraulic cylinder 68 is turnably attached to the coupling section 632*d*.

In addition, the coupling sections 631*d* are provided inside near the rear end 631*a* of the roof shoe right side front section 631, and a second end 68*b* on the cylinder side of each hydraulic cylinder 68 is turnably attached to the coupling section 631*d*. Turning centers of the first end 68*a* and the second end 68*b* of each hydraulic cylinder 68 are approximately parallel to the width direction B.

When the hydraulic cylinders 68 contract, the coupling section 632*d* coupled to the first end 68*a* turns toward the front of the sheet whereby the rear end 632*a* of the roof shoe right side rear section 632 turns in the direction toward the front of the sheet about the shaft G4. Consequently, the rear end 632*a* of the roof shoe right side rear section 632 is able to move to the inside (in the direction approaching the cutter head support 22) (see direction N1 in FIG. 11B and FIG. 12).

When the hydraulic cylinders 68 extend, the coupling section 632*d* coupled to the first end 68*a* turns toward the back of the sheet whereby the rear end 632*a* of the roof shoe right side rear section 632 turns in the direction toward the back of the sheet about the coupling shaft G4. Consequently, the rear end 632*a* of the roof shoe right side rear section 632 is able to move to the outside (in the direction away from the cutter head support 22) (see direction N2 in FIG. 11B and FIG. 12).

(Rear Body Section 12)

The rear body section 12 has the gripper section 70 and a gripper carrier 71 as illustrated in FIG. 1A. The gripper section 70 protrudes to the outside from the gripper carrier 71 and presses the tunnel inner wall when excavating and supports the rear body section 12 against the tunnel inner wall. The gripper section 70 has a pair of side grippers 72 provided on the left and right sides of the gripper carrier 71, a lower gripper 73 provided on the lower side of the gripper carrier 71, and an upper gripper 74 provided on the upper side of the gripper carrier 71.

Each of the side grippers 72, the lower gripper 73 and the upper gripper 74 can be moved inward and outward by the hydraulic cylinder.

<Operation of Tunnel Excavation Device>

The tunnel excavation device 1 of the present embodiment causes the side grippers 72, the lower gripper 73, and the upper gripper 74 of the rear body section 12 to extend to the outside so that the rear body section 12 is supported against the tunnel inner wall. Then the thrust cylinders 13*a* extend, the front body section 11 travels forward with respect to the rear body section 12, and the cutter head 21 performs excavation. During excavation, the excavation can be performed in a stable manner by the roof shoe 51, the vertical shoe 34, and the side shoes 41 sliding against the tunnel inner wall.

Next, the main beam 14 is supported upward with hydraulic pressure using the rear support 18 and then the thrust cylinders 13*a* contract and the rear body section 12 travels forward.

By repeating these actions, the tunnel excavation device 1 moves forward while excavating.

Figure 13:
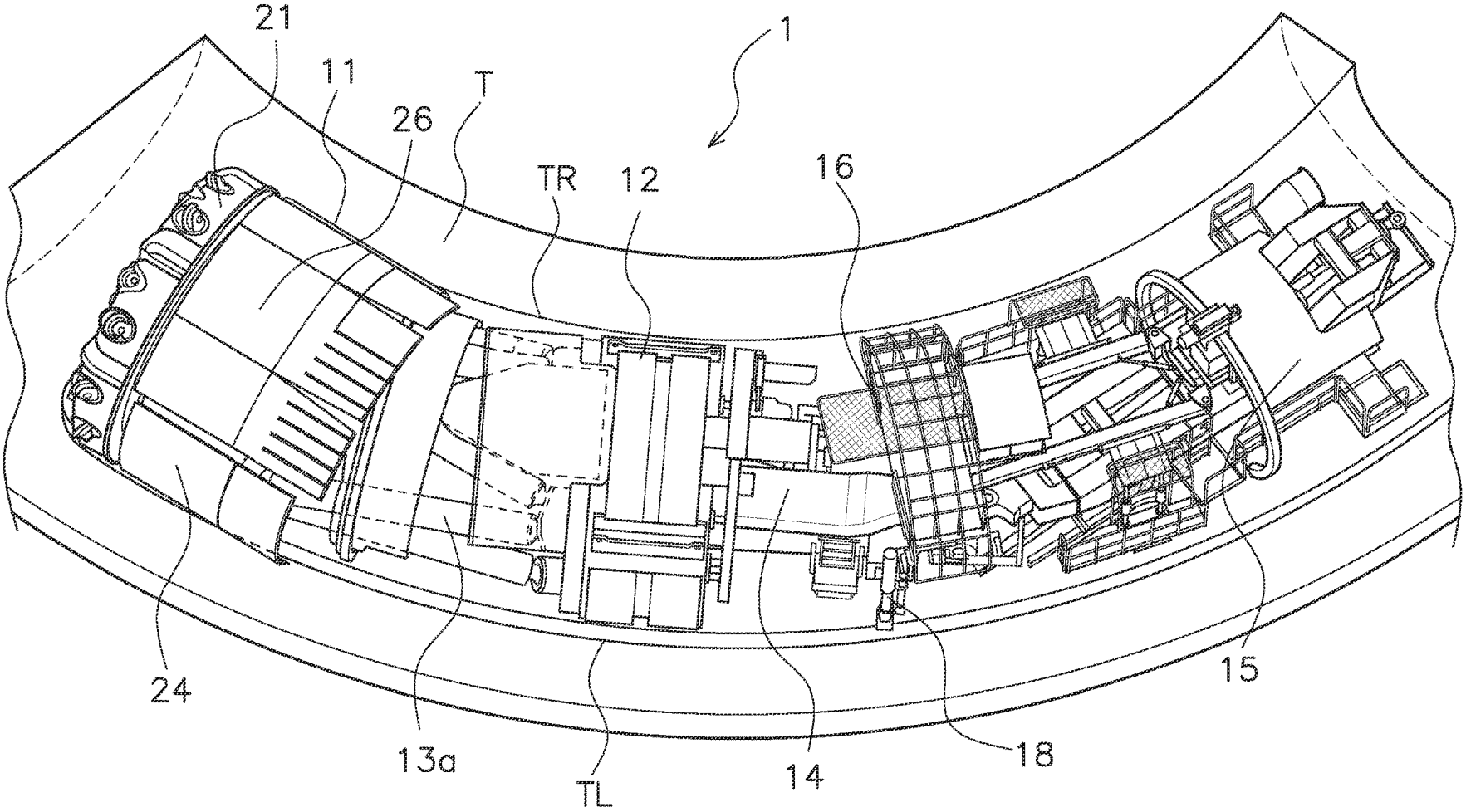
FIG. 13 is a diagram showing a state in which the tunnel excavation device of FIG. 1A is performing curved construction.

Next, as shown in FIG. 13, a case where the tunnel excavation device 1 of the present embodiment performs sharp curve construction will be described.

In FIG. 13, a tunnel T bent to the right in the traveling direction is shown.

The side grippers 72, the lower gripper 73, and the upper gripper 74 of the rear body section 12 are projected outward, and the rear body section 12 is supported on the inner wall of the tunnel.

Then, the thrust cylinder 13*a* is extended to advance the front body section 11 so that the front body section 11 bends to the right with respect to the rear body section 12 along the construction curve.

At this time, the vertical shoe 34 illustrated in FIG. 7 turns along a curve as the tunnel excavation device 1 moves. The vertical shoe 34 turns clockwise in FIG. 7 in order to bend toward the right in FIG. 13.

Further, as illustrated in FIG. 2, when advancing the front body section 11, the side shoe rear section 412 of the side shoe 41 on the outer side of the curve is turned about the coupling shaft G1 so as to move the rear end 412*b* thereof inward (direction of arrow F1). Consequently, interference by the side support 24 on the outer circumferential side on the tunnel pit wall can be prevented when curving. In FIG. 2, a right side inner wall TR and a left side inner wall TL of the tunnel T1 are depicted with dashed lines.

Figure 14A:
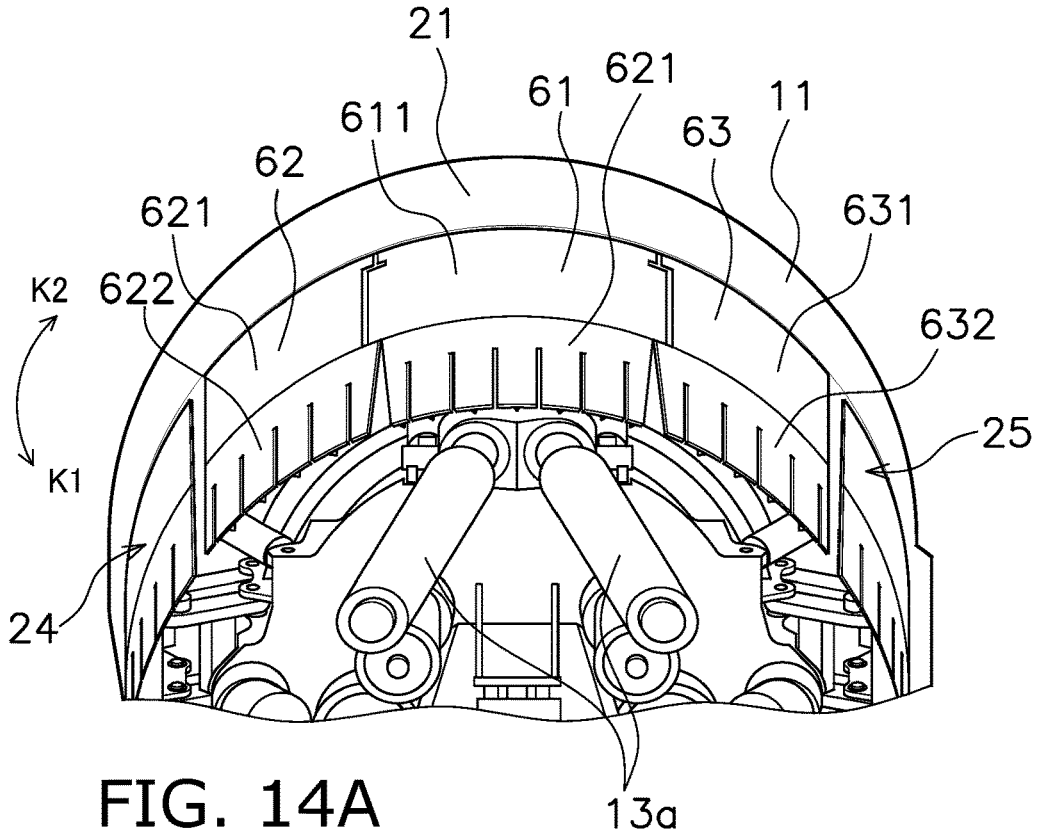
FIG. 14A is a perspective view of a front body section showing a state of the roof shoe when performing straight line construction.
Figure 14B:
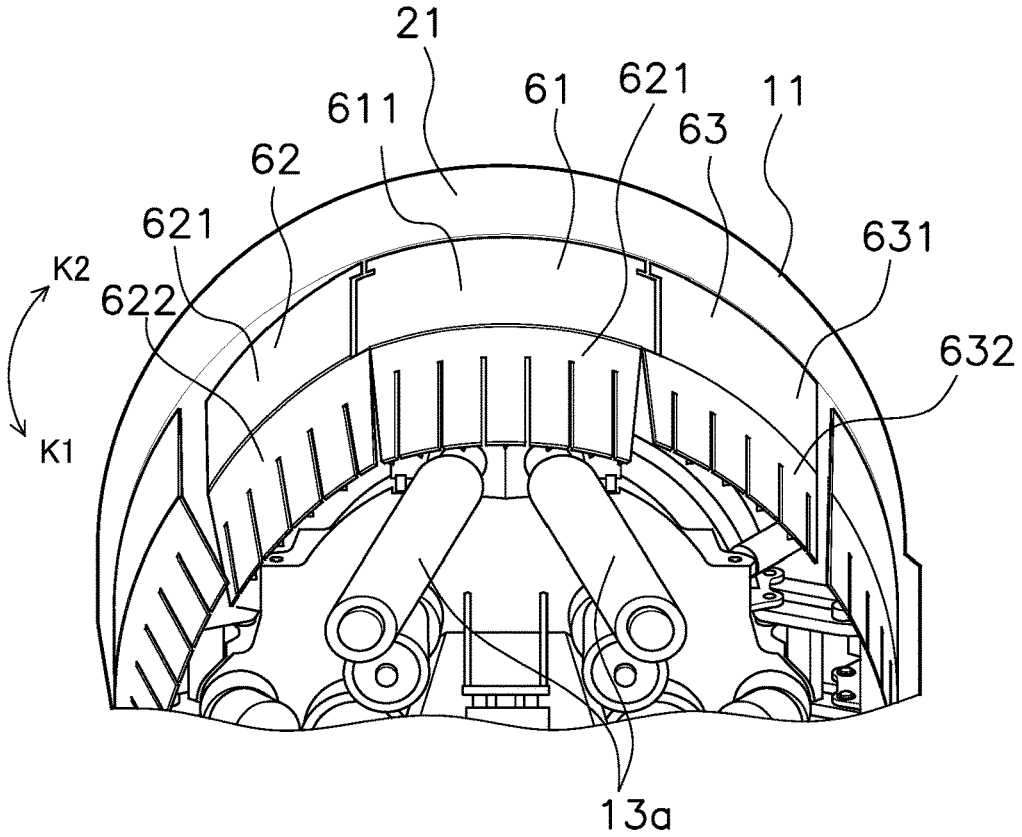
FIG. 14B is a front body section showing a state of the roof shoe when performing curved line construction of FIG. 13.

Further, the left end 62*a* of the roof shoe left side section 62 located on the external diameter side of the curve in the roof shoe 51 is turned inward so as to approach the cutter head support 22 in order to bend toward the right. FIG. 14A is a view showing the front body section 11 in a state of traveling linearly, and the roof shoe left side section 62 is not turned. FIG. 14B is a view showing the front body section 11 when turning to the right as illustrated in FIG. 13, and the roof shoe left side section 62 is turned inward. As illustrated in FIG. 14B, by turning the roof shoe left side section 62 inward, it is possible to prevent the roof shoe left side section 62 from interfering with the curvature of the ceiling surface of the tunnel T when turning to the right side. When turning to the left side, the right end 63*b* of the roof shoe right side section 63 located on the external diameter side of the curve in the roof shoe 51 may be turned inward so as to approach the cutter head support 22.

The operation of the hydraulic cylinders 33, 44, 53, and 64 to 68 that drive the vertical support 23, the side supports 24 and 25, and the roof support 26 may all or partially be performed automatically with a controller, or may be operated by a worker. The controller has a processor and a memory and the operation is performed automatically by the processor executing a program in the memory.

The tunnel excavation device 1 of the present embodiment has the front body section 11 and the rear body section 12. The front body section 11 has the cutter head 21, the cutter head support 22 (example of a cutter head support section) and the vertical shoe 34 (example of a lower shoe).

The rear body section 12 is disposed the rear of the front body section 11 and has the gripper section 70 for obtaining a reaction force when excavating. The cutter head 21 has a plurality of roller cutters 21*a* (example of a cutter). The cutter head support 22 supports the cutter head 21. The vertical shoe 34 is disposed below the cutter head support 22 and is provided in a turnable manner to the cutter head support section.

Since the vertical shoe 34 is provided in a turnable manner with respect to the cutter head support 22 in this way, the vertical shoe 34 automatically turns along the shape of the ground to be constructed on the curve when performing the curved line construction. Therefore, it is possible to perform sharp curve construction.

In the tunnel excavation device 1 of the present embodiment, the front body section 11 further has the hydraulic cylinder 33 that is capable of moving the vertical shoe 34 in the direction H1 approaching the cutter head support 22 and the direction H2 away from the cutter head support 22. The hydraulic cylinder 33 is disposed at the center of rotation of the vertical shoe 34.

In this way, by pressing the vertical shoe 34 that turns along the curve against the ground by the hydraulic cylinder 33, the cutter head 21 can be stably supported, so that stable excavation can be performed even in curve construction.

In the tunnel excavation device 1 of the present embodiment, the front body section 11 further has a pair of side shoes 41 (an example of lateral shoes) disposed lateral to the cutter head support 22. Each of side shoes 41 has the side shoe front section 411 (an example of a lateral shoe front section) and the side shoe rear section 412 (an example of a lateral shoe rear section). The side shoe front section 411 is connected to the cutter head support 22. The side shoe rear section 412 is disposed on the rear side of the side shoe front section 411 and the side shoe rear section 412 is coupled in a turnable manner to the side shoe front section 411. The side shoe rear section 412 is configured so that the rear end 412*b* of the side shoe rear section 412 is turnable in a horizontal direction about the coupling section 412*c* with the side shoe front section 411.

According to such a configuration, when performing a sharp curve construction, the rear end 412*b* of the side shoe rear section 412 of the side shoe 41 on the outer circumferential side of the curve can be turned so as to approach the cutter head support 22. As a result, it is possible to prevent the side shoe 41 from interfering with the inner wall of the tunnel, and it is possible to perform sharp curve construction. It is preferable to slide the side shoe 41 on the inner wall of the tunnel rather than completely separating the side shoe 41 from the inner wall of the tunnel because the thrust in the left-right direction can be increased and the stability during excavation can be achieved.

Further, when performing a sharp curve construction, the side shoe rear section 412 of the side shoe 41 on the inner circumferential side of the curve is turned so that the rear end 412*b* is away from the cutter head support 22 and the side shoe rear section 412 slides on the inner wall of the tunnel, whereby the thrust in the left-right direction can be increased.

In the tunnel excavation device 1 of the present embodiment, the front body section 11 has the hydraulic cylinder 44 (an example of a first actuator). The hydraulic cylinder 44 is disposed between the side shoe front section 411 and the cutter head support 22, and can move the side shoe front section 411 in the direction E1 approaching the cutter head support 22 and in the direction E2 away from the cutter head support 22.

As a result, it is possible to slide the side shoe 41 onto the inner wall of the tunnel by operating the hydraulic cylinder 44 and even in curved construction, the thrust in the left-right direction can be increased to perform stable excavation.

Further, since the side shoe rear section 412 can be turned, the side shoe 41 can be easily slid on the inner wall of the tunnel even during curve construction, and stable excavation can be performed.

In the tunnel excavation device 1 of the present embodiment, the front body section 11 has the roof shoe 51 (example of an upper shoe) disposed above the cutter head support 22. The roof shoe 51 has the roof shoe center section 61 (example of an upper shoe center section), and the roof shoe left side section 62 (example of an upper shoe side section) and the roof shoe right side section 63 (example of an upper shoe side section). The roof shoe left side section 62 and the roof shoe right side section 63 are disposed at both side in the width direction B of the roof shoe center section 61, and are turnably coupled to the roof shoe center section 61. The roof shoe left side section 62 is configured so that the left end 62*a* (example of an end on an outside) of the roof shoe left side section 62 is able to turn in the up-down direction about the coupling section 62*c* with the roof shoe center section 61. The roof shoe right side section 63 is configured so that the right end 63*b* (example of an end on an outside) of the roof shoe right side section 63 is able to turn in the up-down direction about the coupling section 63*c* with the roof shoe center section 61.

According to such a configuration, when performing sharp curve construction, the outer end of the upper shoe side section on the outer circumferential side of the curve among the roof shoe left side section 62 and the roof shoe right side section 63 can be turned so as to approach the cutter head support 22. Therefore, it is possible to prevent the roof shoe 51 from interfering with the inner wall of the tunnel, and it is possible to perform sharp curve construction. It is preferable to slide the roof shoe side section on the inner wall of the tunnel rather than completely separating the roof shoe side section from the inner wall of the tunnel because the thrust in the left-right direction can be increased and the stability during excavation can be achieved.

Further, when performing a sharp curve construction, the outer end of the upper shoe side section on the inner circumferential side of the curve among the roof shoe left side section 62 and the roof shoe right side section 63 is turned so as to be away from the cutter head support 22 and the upper shoe side section slides on the inner wall of the tunnel, whereby the thrust in the left-right direction can be increased.

(6)

In the tunnel excavation device 1 of the present embodiment, the front body section 11 further includes the hydraulic cylinder 53 (an example of a second actuator). The hydraulic cylinder 53 is arranged between the roof shoe center section 61 and the cutter head support 22, and can move the roof shoe center section 61 in the direction J1 approaching the cutter head support 22 and in the direction J2 away from the cutter head support 22.

Stable excavation can be performed by operating the hydraulic cylinder 53 and sliding the roof shoe 51 on the inner wall of the tunnel.

Further, since the roof shoe left side section 62 and the roof shoe right side section 63 can be turned about the front-rear direction A, the roof shoe 51 can be easily slid on the inner wall of the tunnel even during curve construction, and stable excavation can be performed.

In the tunnel excavation device 1 of the present embodiment, the roof shoe center section 61 (an example of the upper shoe center section) has the roof shoe center front section 611 (example of an upper shoe center front section) and the roof shoe center rear section 612 (example of an upper shoe center rear section). The roof shoe center front section 611 is connected to the cutter head support 22. The roof shoe center rear section 612 is disposed to the rear of the roof shoe center front section 611 and is configured so that the rear end 612*a* of the roof shoe center rear section 612 is able to turn in the up-down direction about the coupling section 612*c* with the roof shoe center front section 611.

It is possible to prevent the roof shoe 51 with the ceiling surface of the tunnel by turning the roof shoe center rear section 612 so that the rear end 612*a* approaches the cutter head support 22 when constructing a tunnel that bends downward. It is preferable to slide the roof shoe center rear section 612 on the inner wall of the tunnel rather than completely separating the roof shoe center rear section 612 from the inner wall of the tunnel because the supporting force of the front body section 11 can be increased and the stability during excavation can be achieved.

In the tunnel excavation device 1 of the present embodiment, the roof shoe left side section 62 (an example of an upper shoe side section) has the roof shoe left side front section 621 (an example of an upper shoe side front section) and the roof shoe left side rear section 622 (an example of an upper shoe side rear section). The roof shoe left side front section 621 is connected to the roof shoe center section 61 (example of the upper shoe center section). The roof shoe left side rear section 622 is disposed on the rear side of the roof shoe left side front section 621 and is coupled in a turnable manner to the roof shoe left side front section 621. The roof shoe left side rear section 622 is configured so that the rear end 622*a* of the roof shoe left side rear section 622 is able to turn in the up-down direction about the coupling section 622*c* with the roof shoe left side front section 621. The roof shoe right side section 63 (example of an upper shoe side section) has the roof shoe right side front section 631 (example of an upper shoe side front section) and the roof shoe right side rear section 632 (example of an upper shoe side rear section). The roof shoe right side front section 631 is connected to the roof shoe center section 61 (example of an upper shoe center section). The roof shoe right side rear section 632 is disposed on the rear side of the roof shoe right side front section 631 and is coupled in a turnable manner to the roof shoe right side front section 631. The roof shoe right side rear section 632 is configured so that the rear end 632*a* of the roof shoe right side rear section 632 is able to turn in the up-down direction about the coupling section 632*c* with the roof shoe right side front section 631.

When constructing so as to bend downward, the rear end 622*a* of the roof shoe left side rear section 622 is turned so as to approach the cutter head, and the rear end 632*a* of the roof shoe right side rear section 632 is turned so as to approach the cutter head. As a result, it is possible to prevent the upper shoe from interfering with the ceiling surface of the tunnel. It is preferable to slide the roof shoe left side rear section 622 and the roof shoe right side rear section 632 on the inner wall of the tunnel rather than completely separating the roof shoe left side rear section 622 and the roof shoe right side rear section 632 from the inner wall of the tunnel because the supporting force of the front body section 11 can be increased and the stability during excavation can be achieved.

While an embodiment of the present disclosure has been explained above, the present disclosure is not limited to the above embodiment and various changes are possible within the scope of the present disclosure.

While in the above embodiment, the hydraulic cylinder 33 is provided to the vertical support 23, it may not be provided. At least the vertical shoe 34 may be provided in a turnable manner with respect to the cutter head support 22.

While in the above embodiment, the rear sections of the side shoe 41 and the roof shoe 51 are configured in a turnable manner so that the side shoe 41 and the roof shoe 51 can be folded, when the length in the front-back direction A is small, the side shoe 41 and the roof shoe 51 may not be configured so as to be folded.

While in the above embodiment, the hydraulic cylinder 33 is rotatably engaged with the vertical shoe 34, the hydraulic cylinder 33 may be fixed to the vertical shoe 34 and the hydraulic cylinder 33 may rotate.

While in the above embodiment, the rear body section 12 is provided with the upper gripper 74, side grippers 72, and the lower gripper 73 on the upper, lower, left, and right sides, but is not limited to this, and for example, the rear body section 12 may be provided with only the side grippers 72.

While in the above embodiment, the hydraulic cylinder 44 is provided as an example of a first actuator, and the hydraulic cylinder 53 is provided as an example of a second actuator, the present invention is not limited to the hydraulic cylinder. The cylinder or the like may be used. The same applies to the other hydraulic cylinders 64 to 68.

The tunnel excavation device of the present disclosure demonstrates the effect of being able to construct a sharp curve and is applied to pit mining.

What is claimed is:

1. A tunnel excavation device comprising:

a front body section including a cutter head including a plurality of cutters, a cutter head support section supporting the cutter head, and a lower shoe disposed below the cutter head support section, the lower shoe being provided in a turnable manner to the cutter head support section; and a rear body section including a gripper section configured to obtain a reaction force when excavating, the rear body section being disposed to rear of the front body section, the front body section including a hydraulic cylinder configured to move the lower shoe in a direction approaching the cutter head support section and in a direction away from the cutter head support section, and the hydraulic cylinder being disposed at a center of rotation of the lower shoe.

2. The tunnel excavation device according to claim 1, wherein the front body section further includes a pair of lateral shoes disposed lateral to the cutter head support section, and each of the lateral shoes includes a lateral shoe front section connected to the cutter head support section, and a lateral shoe rear section disposed on a rear side of the lateral shoe front section and coupled in a turnable manner to the lateral shoe front section, and the lateral shoe rear section is configured so that a rear end of the lateral shoe rear section is turnable in a horizontal direction about a coupling section with the lateral shoe front section.

3. The tunnel excavation device according to claim 2, wherein the front body section further includes a first actuator disposed between the lateral shoe front section and the cutter head support section, the first actuator being configured to move the lateral shoe front section in a direction approaching the cutter head support section and in a direction away from the cutter head support section.

4. The tunnel excavation device according to claim 1, wherein the front body section includes an upper shoe disposed above the cutter head support section, and the upper shoe includes an upper shoe center section, and upper shoe side sections disposed on either side in a width direction of the upper shoe center section and coupled in a turnable manner to the upper shoe center section, each of the upper shoe side sections being configured so that an end on an outside of the upper shoe side section is turnable in a vertical direction about a coupling section with the upper shoe center section.

5. The tunnel excavation device according to claim 4, wherein the front body section further includes a second actuator disposed between the upper shoe center section and the cutter head support section, the second actuator being configured to move the upper shoe center section in a direction approaching the cutter head support section and in a direction away from the cutter head support section.

6. A tunnel excavation device comprising:

a front body section including a cutter head including a plurality of cutters, a cutter head support section supporting the cutter head, and a lower shoe disposed below the cutter head support section, the lower shoe being provided in a turnable manner to the cutter head support section; and a rear body section including a gripper section configured to obtain a reaction force when excavating, the rear body section being disposed to rear of the front body section, the front body section including an upper shoe disposed above the cutter head support section, the upper shoe including an upper shoe center section, and upper shoe side sections disposed on either side in a width direction of the upper shoe center section and coupled in a turnable manner to the upper shoe center section, each of the upper shoe side sections being configured so that an end on an outside of the upper shoe side section is turnable in a vertical direction about a coupling section with the upper shoe center section, and the upper shoe center section including an upper shoe center front section coupled to the cutter head support section, and an upper shoe center rear section disposed on a rear side of the upper shoe center front section and coupled in a turnable manner to the upper shoe center front section, the upper shoe center rear section being configured so that a rear end of the upper shoe center rear section is turnable in a vertical direction about a coupling section with the upper shoe center front section.

7. A tunnel excavation device comprising:

a front body section including a cutter head including a plurality of cutters, a cutter head support section supporting the cutter head, and a lower shoe disposed below the cutter head support section, the lower shoe being provided in a turnable manner to the cutter head support section; and a rear body section including a gripper section configured to obtain a reaction force when excavating, the rear body section being disposed to rear of the front body section, the front body section including an upper shoe disposed above the cutter head support section, the upper shoe including an upper shoe center section, and upper shoe side sections disposed on either side in a width direction of the upper shoe center section and coupled in a turnable manner to the upper shoe center section, each of the upper shoe side sections being configured so that an end on an outside of the upper shoe side section is turnable in a vertical direction about a coupling section with the upper shoe center section, and each of the upper shoe side sections including an upper shoe side front section coupled to upper shoe center section, and an upper shoe side rear section disposed on a rear side of the upper shoe side front section and coupled in a turnable manner to the upper shoe side front section, the upper shoe side rear section being configured so that a rear end of the upper shoe side rear section is turnable in a vertical direction about a coupling section with the upper shoe side section.

* * * * *